US007321190B2

(12) United States Patent
Nakanishi et al.

(10) Patent No.: US 7,321,190 B2
(45) Date of Patent: Jan. 22, 2008

(54) LOW-PRESSURE MERCURY LAMP HAVING A SPIRAL ARC TUBE AND METHOD FOR ASSEMBLING THE SAME

(75) Inventors: Akiko Nakanishi, Takatsuki (JP); Yoshinori Kakuno, Katano (JP); Shiro Iida, Kyoto (JP); Kenji Itaya, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 166 days.

(21) Appl. No.: 10/520,859

(22) PCT Filed: Jul. 22, 2003

(86) PCT No.: PCT/JP03/09234

§ 371 (c)(1),
(2), (4) Date: Oct. 3, 2005

(87) PCT Pub. No.: WO2004/010460

PCT Pub. Date: Jan. 29, 2004

(65) Prior Publication Data

US 2006/0108908 A1 May 25, 2006

(30) Foreign Application Priority Data

Jul. 22, 2002 (JP) ..... 2002-212911

(51) Int. Cl.
*H01J 5/00* (2006.01)

(52) U.S. Cl. ..... 313/318.02; 313/317; 313/318.01

(58) Field of Classification Search .... 313/317–318.12
See application file for complete search history.

(56) References Cited

U.S. PATENT DOCUMENTS

| | | | | |
|---|---|---|---|---|
| 5,675,215 | A | 10/1997 | Watson et al. | 313/493 |
| 5,731,656 | A * | 3/1998 | Greiler et al. | 313/318.01 |
| 2002/0105255 | A1 * | 8/2002 | Bankuti et al. | 313/318.02 |

FOREIGN PATENT DOCUMENTS

| | | | |
|---|---|---|---|
| EP | 0735569 | A2 | 1/1996 |
| EP | 1 182 688 | A1 | 2/2002 |
| JP | 8-339780 | | 12/1996 |
| WO | WO 03/083360 | A1 | 10/2003 |

* cited by examiner

*Primary Examiner*—Nimeshkumar D. Patel
*Assistant Examiner*—Bumsuk Won

(57) ABSTRACT

An arc tube is formed by a glass tube that is turned at a substantially middle thereof and wound around a spiral axis from the middle, to have a double-spiral structure. End portions of the arc tub are wound around the spiral axis. A holder has insertion openings formed therein in such shapes that correspond to shapes of the ends of the arc tube. The insertion openings allow the ends of the arc tube to be inserted along a bottom wall of the holder. The holder also includes guide grooves provided in the areas before the insertion openings in the spiral direction of the ends of the arc tube. The guide grooves allow the end portions of the arc tube to come in contact, and when the arc tube is rotated around the axis, guide the ends of the arc tube to the insertion openings.

14 Claims, 16 Drawing Sheets

LOW-PRESSURE MERCURY LAMP HAVING A SPIRAL ARC TUBE AND METHOD FOR ASSEMBLING THE SAME

TECHNICAL FIELD

The present invention relates to a low-pressure mercury lamp that includes a holder holding an arc tube in a state where at least one end of the arc tube is inserted in an insertion opening formed in the holder, and a method for assembling the low-pressure mercury lamp.

BACKGROUND ART

In the present energy-saving era, a lot of efforts have been made to develop low-pressure mercury lamps. In particular, fluorescent lamps, specifically compact self-ballasted fluorescent lamps that exhibit high luminous efficiency and long life, are calling attentions as light sources alternative to incandescent lamps. As one example, compact self-ballasted fluorescent lamps may include double-spiral arc tubes formed so that end portions stand vertically and remaining portions are wound in a double spiral around the axis of spiral.

Compact self-ballasted fluorescent lamps including such double-spiral arc tubes have a higher total height than that of incandescent lamps. The problem therefore is that such a compact self-ballasted fluorescent lamp may partially protrude from an existing lighting fixture designed for an incandescent lamp. To solve this problem, the inventors of the present application have come up with the idea that the total height of compact self-ballasted fluorescent lamps can be reduced by winding also the end portions of the arc tube, which had conventionally been formed to stand vertically, into a double spiral around the axis of spiral. With this idea, the inventors have succeeded in downsizing compact self-ballasted fluorescent lamps to substantially the same size as incandescent lamps.

FIG. 1 shows a holding member for holding an arc tube whose end portions are formed in a double spiral. As shown in the figure, the holding member 906 is in a cylindrical shape whose one end is closed, and has, on its closed end, i.e., on its bottom wall 961, a pair of tubular parts in which a pair of insertion openings 963 and 964 are formed for allowing both ends of the arc tube to be inserted therethrough. The holding member 906 holds the arc tube by bonding the ends of the arc tube that have been inserted therein through the insertion openings 963 and 964 to the inner surface of the holding member 906 via a bonding agent.

Although compact self-ballasted fluorescent lamps including the above-described arc tube whose end portions are formed in a double spiral can have a low total height substantially the same as that of incandescent lamps, a problem still remains as that inserting the ends of the arc tube thorough the insertion openings 963 and 964 of the holding member 906 is extremely difficult. To be more specific, the insertion of the ends of the arc tube is extremely difficult because the insertion openings 963 and 964 are provided in directions opposite to each other. Once one end of the arc tube is inserted through the insertion opening 963, the other end of the arc tube goes off from the insertion opening 964.

The insertion of the ends of the arc tube through the insertion openings 963 and 964 can be made relatively easy by enlarging the insertion openings 963 and 964. If the insertion openings 963 and 964 are large, however, another problem arises when the ends of the arc tube are bonded to the inner surface of the holding member 906 via a bonding agent. The problem is that the bonding member may flow out from the insertion openings 963 and 964, thereby leading to serious degradation of the appearance.

DISCLOSURE OF THE INVENTION

In view of the above problems, the object of the present invention is to provide a low-pressure mercury lamp in which ends of an arc tube can be easily inserted into a holding member without for example enlarging the insertion openings, and also to provide a method for assembling the low-pressure mercury lamp.

The above object of the present invention can be achieved by a low-pressure mercury lamp, including: an arc tube whose at least one end is wound around an axis entirely in a longitudinal direction thereof; and a holding member that holds the arc tube in a state where the at least one end is inserted in an opening formed in the holding member, wherein the holding member includes an insertion-guiding unit for guiding the at least one end of the arc tube to be inserted into the opening while preventing positional deviation of the at least one end, when the arc tube is rotated around the axis to be attached to the holding member.

According to this construction, by rotating the arc tube around the spiral axis with the end of the arc tube being in contact with the insertion-guiding unit, the end of the arc tube can be easily inserted into the opening formed in the holding member. It should be noted here that the above longitudinal direction is the direction in which the end of the arc tube is wound around the axis, i.e., the spiral direction.

In particular, the insertion-guiding unit may be formed as a groove extending in a direction in which the end of the arc tube is wound around the axis.

Also, a part of the groove that comes in contact with a part of the end of the arc tube may have a shape corresponding to a shape of the part of the end of the arc tube.

According to this construction, the end of the arc tube can be guided to be inserted into the opening of the holding member while the positional deviation of the arc tube is being prevented.

Further, the arc tube may include a pair of lead wires for an electrode extending from the end of the arc tube, the opening may open toward a direction of the axis, and the holding member may allow the pair of lead wires to be inserted in the opening.

In particular, the opening may be formed at an angle of 20 to 60° inclusive with respect to the axis.

According to this construction, by making the lead wires in parallel with the spiral-axis direction of the arc tube and moving the arc tube toward the holding member in the spiral-axis direction before for example attaching the arc tube to the holding member, the lead wires can be easily inserted into the holding member through the opening.

Also, the holding member may include a covering unit that is formed so that the opening is positioned at an edge of the covering unit, the covering unit covering the end of the arc tube, and the opening may be partially formed by a notch created in the covering unit and/or the insertion-guiding unit.

According to this construction, by making the lead wires in parallel with the spiral-axis direction of the arc tube and moving the arc tube toward the holding member in the spiral-axis direction before for example attaching the arc tube to the holding member, the lead wires can be easily inserted into the holding member through the notch.

On the other hand, the end of the arc tube may be bonded within the holding member via a bonding agent.

Further, the insertion-guiding unit may include one or more inlets for injecting the bonding agent in an area between (a) the end of the arc tube placed in the holding member and (b) the insertion-guiding unit of the holding member.

Alternatively, the holding member may include a wall at an internal surface thereof for preventing the bonding agent from flowing outside.

This construction ensures that the arc tube is firmly held by the holding member.

Further, the arc tube may include a pair of lead wires for an electrode extending from the end of the arc tube, and the holding member may include a supporting unit for supporting the pair of lead wires while keeping a certain distance between the lead wires.

According to this construction, the lead wires are held with a certain distance kept between them. Therefore, for example, crossing or entangling of the lead wires can be reduced.

Further, the arc tube may include a glass tube that is turned at a substantially middle thereof and wound around the axis from the middle, to have a double-spiral structure.

According to this construction, the total height of the arc tube can be made lower than an arc tube whose end portions are parallel with the spiral axis.

The above object of the present invention can also be achieved by a method for assembling a low-pressure mercury lamp including: an arc tube whose at least one end is wound around an axis entirely in a longitudinal direction thereof; and a holding member that includes an insertion-guiding unit for guiding the at least one end of the arc tube to be inserted into an opening formed in the holding member while preventing positional deviation of the at least one end, wherein a process of attaching the arc tube to the holding member includes the steps of: making the at least one end of the arc tube come in contact, at a peripheral surface thereof, with the insertion-guiding unit of the holding member; and rotating, in a state where the at least one end of the arc tube is in contact with the insertion-guiding unit, the arc tube and/or the holding member around the axis, so that the arc tube has a relative position with respect to the opening of the holding member.

According to this method, the arc tube can be easily attached to the holding member. Further, the end of the arc tube can be easily inserted into the holding member by rotating the arc tube with its end being in contact with the insertion-guiding unit at a peripheral surface thereof. Therefore, automation of this process becomes possible. It should be noted here that the above longitudinal direction is the direction in which the end of the arc tube is wound around the axis, i.e., the spiral direction.

Also, the arc tube may have a pair of lead wires for an electrode extending from the end of the arc tube, the opening may open toward a direction of the axis, and the step of making the at least one end of the arc tube come in contact with the insertion-guiding unit of the holding member may be carried out in a state where the lead wires are parallel to the direction of the axis.

According to this method, by making the arc tube come in contact with the holding member with the tips of the lead wires and the opening being at the same positions in the spiral-axis direction, the lead wires can be easily inserted into the holding member.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

BEST MODE FOR CARRYING OUT THE INVENTION

First Embodiment

Figure 1:
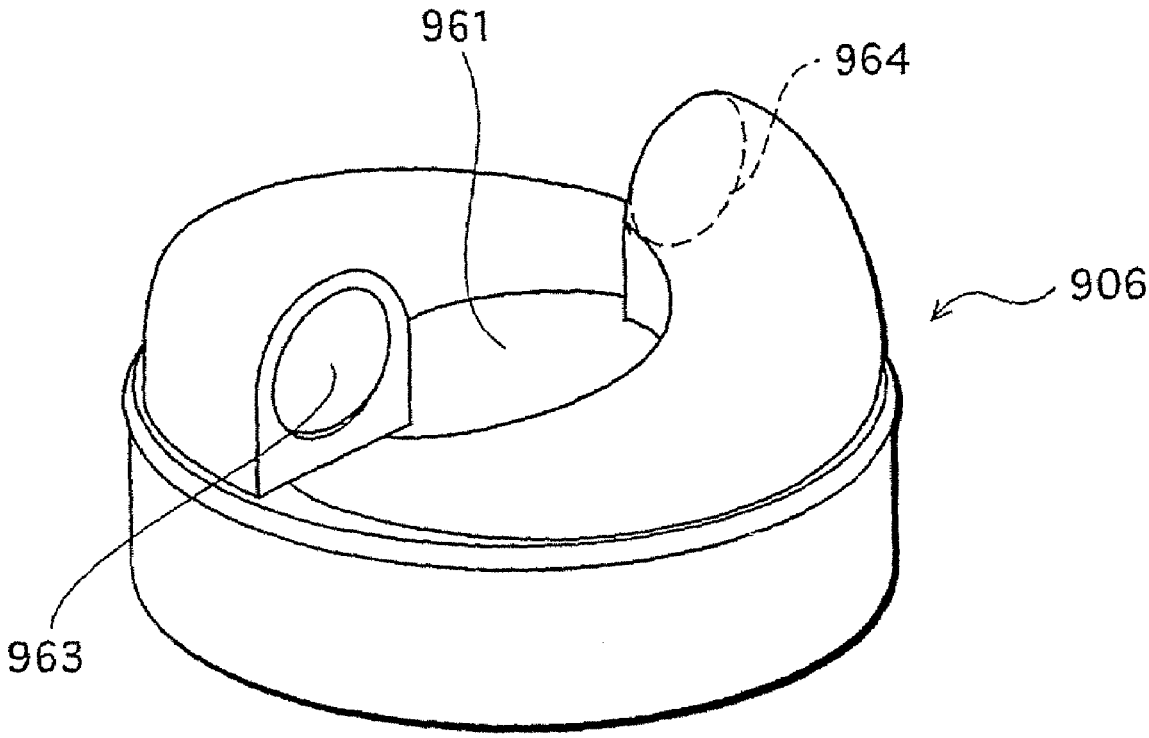
FIG. 1 PRIOR ART
FIG. 1 is a perspective view of a holder according to a conventional technique as viewed diagonally from above.
Figure 2:
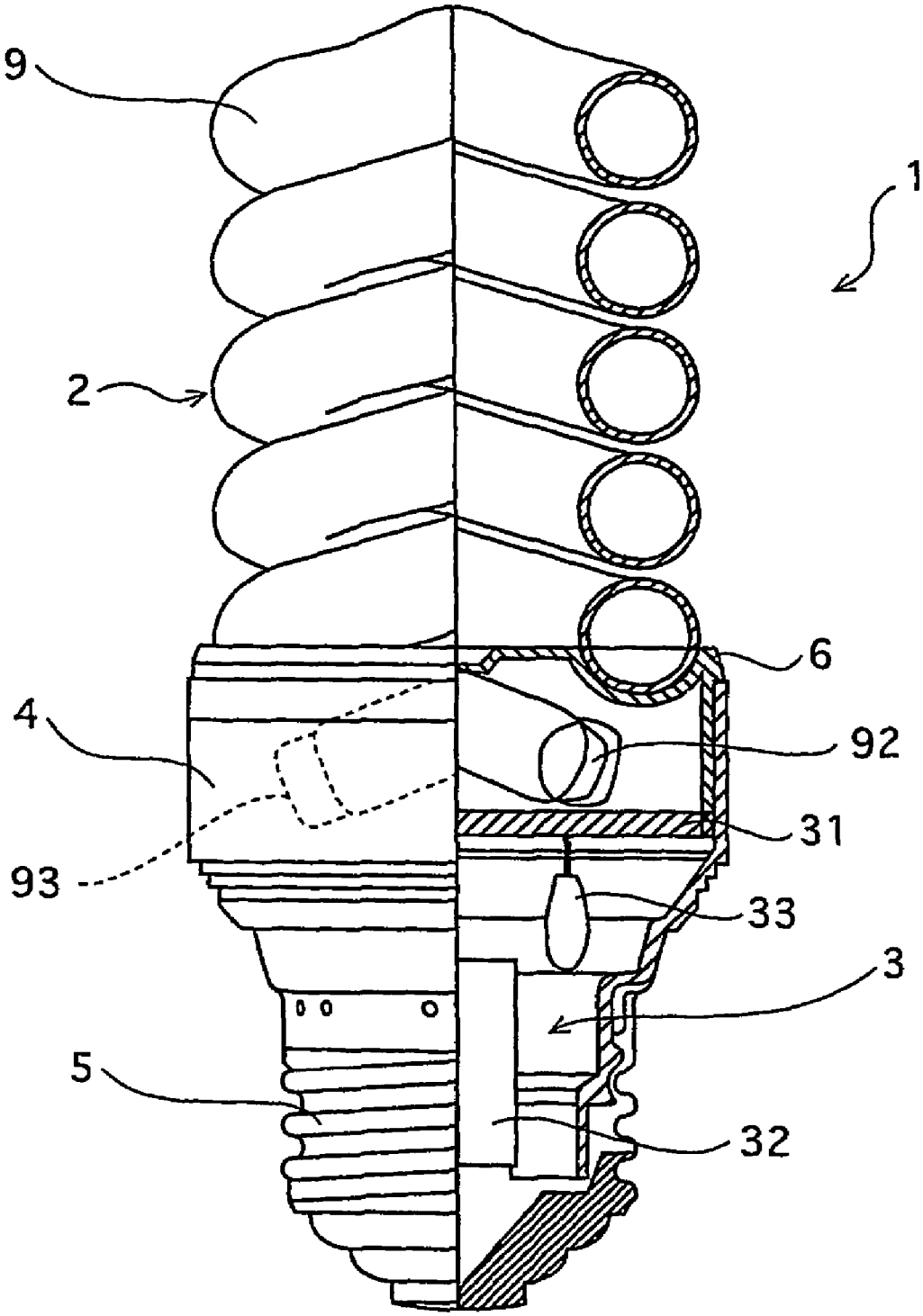
FIG. 2 is a front view showing the overall construction of a compact self-ballasted fluorescent lamp according to a first embodiment of the present invention, with its right half being cut away.

1. Construction of the Compact Self-ballasted Fluorescent Lamp (1) Overall Construction FIG. 2 is a front view showing the overall construction of a compact self-ballasted fluorescent lamp according to a first embodiment of the present invention, with its substantially half being cut away. The compact self-ballasted fluorescent lamp 1 is a 12 W lamp that is an alternative to a 60 W incandescent lamp. It should be noted here that a 60 W incandescent lamp has a maximum outer diameter of 60 mm and a total height of 110 mm.

As shown in the figure, the compact self-ballasted fluorescent lamp 1 includes an arc tube 2 that has a double-spiral structure, an electronic ballast 3 for lighting the arc tube 2, and a case 4 containing the electronic ballast 3 and having a base 5.

Figure 3:
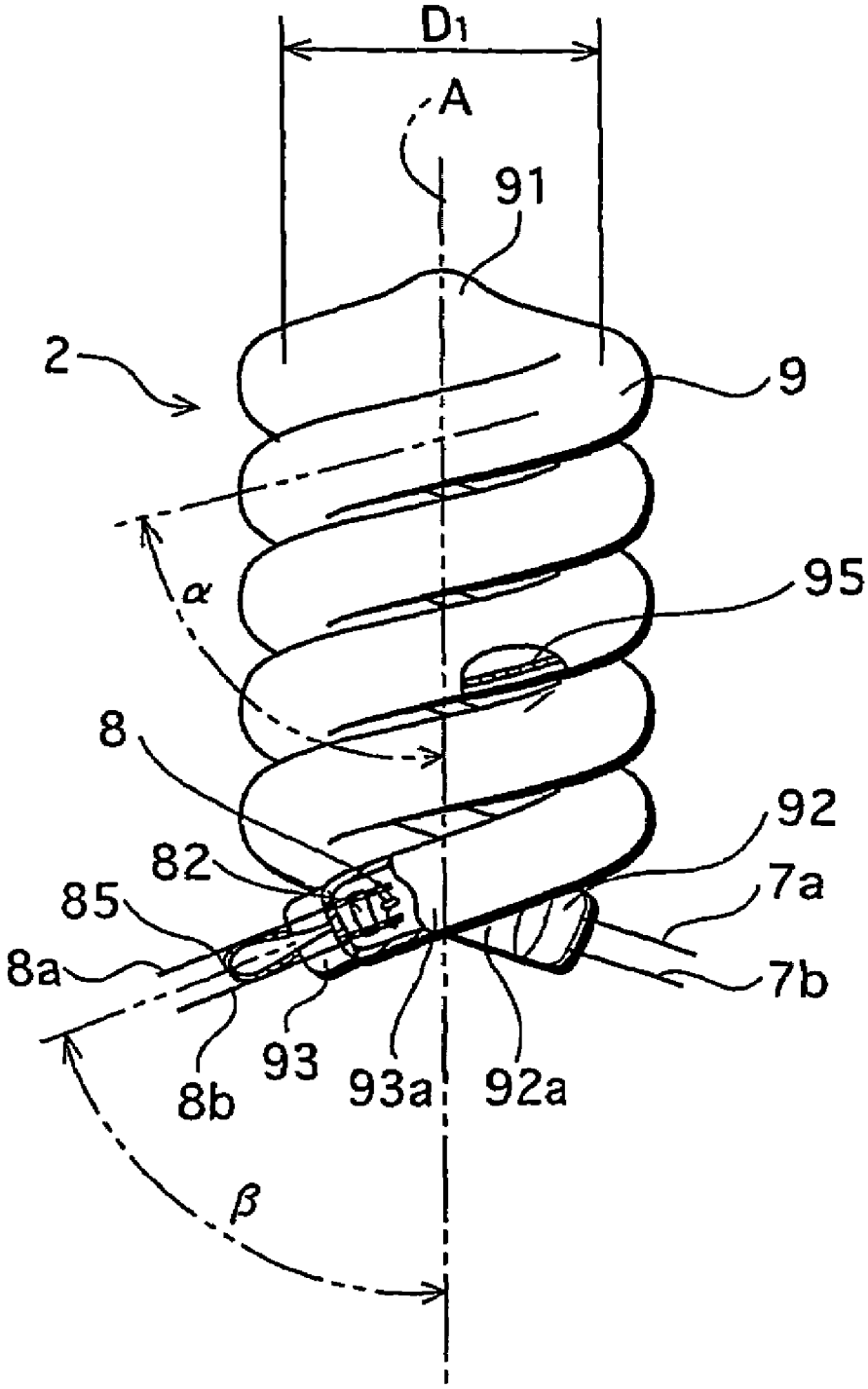
FIG. 3 is a front view showing the construction of an arc tube according to the first embodiment, with being partially cut away.

FIG. 3 is a front view showing the construction of the arc tube 2 being partially cut away.

As shown in FIGS. 2 and 3, the arc tube 2 is formed by bending one glass tube 9. To be more specific, the glass tube 9 is turned at a turning portion 91 positioned substantially middle thereof, and is wound around an axis of spiral "A" from the turning portion 91 to its both ends 92 and 93 at an angle of spiral.

It should be noted here that the glass tube 9 is wound at a spiral angle "α" (75° in the present embodiment) with respect to the spiral axis "A" from a position of the turning portion 91 until positions just before its end portions in the vicinity of the ends 92 and 93, and is wound at a spiral angle "β" (about 68° in the present embodiment) with respect to the spiral axis "A" from positions at the start of the end portions until positions of the ends 92 and 93. It should also be noted here that in the present embodiment the end portions of the glass tube each extend, as viewed from above, in a range of about ¼ winds from the end of the glass tube in a direction where the turning portion 91 is positioned.

The spiral angle of the glass tube 2 with respect to the spiral axis "A" is changed in the vicinity of the ends 92 and 93, for the purpose of making the ends 92 and 93 away from portions of the glass tube 9 adjacent to the ends 92 and 93 in a direction parallel to the spiral axis "A" (hereafter simply referred to as a "spiral-axis direction"), and thereby allowing the arc tube 2 to be easily held by a holder, which is described later.

Hereafter, the direction in which the glass tube 9 is wound around the spiral axis "A" at the spiral angle (the direction in which the glass tube 9 is wound from its turning portion to ends) is referred to as the "spiral direction". For the compact self-ballasted fluorescent lamp 1, the side where the tuning portion 91 of the arc tube 2 is positioned is assumed to be the "upper side", and the side where the base 5 is positioned is assumed to be the "lower side".

The glass tube 9 has a tube inner diameter of 7.4 mm, a tube outer diameter of 9.0 mm. A gap between every adjacent portions of the glass tube 9 in the spiral-axis direction, excluding the end portions, is about 1 mm, and a gap between the ends 92 and 93 and adjacent portions of the glass tube 9 is about 6 mm at the maximum. The glass tube 9 is wound from the turning portion 91 to the ends 92 and 93 around the spiral axis "A" by substantially 4.5 winds. The arc tube 2 with a double-spiral structure has a total height of 60 mm and a maximum outer diameter of 37 mm.

As shown in FIG. 3, an electrode 8 is sealed at the end 93 of the glass tube 9. As one example, a coil electrode made of tungsten is used as the electrode 8. The coil electrode is supported by a pair of lead wires 8*a* and 8*b* temporarily fixed via bead glass 82 (by way of a "bead glass mounting method").

Although not shown in the figure, an electrode is also sealed at the end 92 of the glass tube 9. In the figure, a pair of lead wires 7*a* and 7*b* connected to the coil electrode (not shown) extends from the end 92.

As shown in FIG. 3, an exhaust tube 85 for exhausting the inside of the glass tube 9 is sealed at one end (the end 93 in this example) of the glass tube 9 at the time when the electrode 8 is sealed there. It should be noted here that the distance between the electrodes within the glass tube 9 is 400 mm.

Here, a rare-earth phosphor 95 is applied to the inner surface of the glass tube 9. The phosphor 95 used here is a mixture of three types of phosphors respectively emitting red, green, and blue light, e.g., $Y_2O_3$:Eu, $LaPO_4$:Ce, Tb, and $BaMg_2Al_{16}O_{27}$:Eu, Mn.

Within the glass tube 9, mercury is singly enclosed by an amount of about 5 mg, and also, a rare gas such as a mixture gas of argon and neon (with a capacity ratio of neon in the mixture gas being substantially 25%) is enclosed at 400 Pa via the exhaust tube 85.

Here, the finished structure of the glass tube 9 in which the phosphor layer 95 has been applied to the inner surface, the rare gas has been enclosed inside, etc., corresponds to the arc tube 2. Hereafter, an explanation given using the arc tube 2 assumes that both ends of the arc tube 2 corresponding to the ends 92 and 93 of the glass tube 9 are referred to as "ends 92 and 93 of the arc tube 2", a portion of the glass tube 9 in the vicinity of its end 92 is referred to as an "end portion 92*a* of the arc tube 2", and a portion of the glass tube 9 in the vicinity of its end 93 is referred to as an "end portion 93*a* of the arc tube 2". It should be noted here that the end portions 92*a* and 93*a* of the arc tube 2 correspond to the "end that is wound around the axis entirely in the longitudinal direction" referred to in the claims of the present invention.

As shown in FIG. 2, the ends 92 and 93 of the arc tube 2 are inserted into a holder 6 and bonded to the holder 6 via such a bonding agent as silicone (not shown). The holder 6 is described in detail later.

As shown in FIG. 2, a substrate 31 is attached at the backside of the holder 6 (at the side where the base 5 is positioned). A plurality of electronic components 32, 33, etc. for lighting the arc tube 2 are mounted on the substrate 31. It should be noted here that these electronic components 32, 33, etc. constitute the electronic ballast 3.

The case 4 is made of a synthetic resin and is in a tubular shape having a larger diameter as closer to its top. The holder 6 to which the arc tube 2 and the substrate 31 are attached is placed in the opening of the case 4 from the side (lower side) where the electronic ballast 3 is positioned and is fixed therein. The base 5 (e.g., an E26 type base) is attached to the bottom end of the case 4, i.e., the side of the case 4 opposite to the opening. It should be noted here that electrical connection between the base 5 and the electronic ballast 3 is not shown in FIG. 2.

The base 5 is of a screw type, with its central axis being substantially matching the spiral axis "A" of the arc tube 2. Hereafter, the central axis of the base 5 may also be referred to as the "central axis of the compact self-ballasted fluorescent lamp 1".

(2) Construction of the Holder

Figure 4:
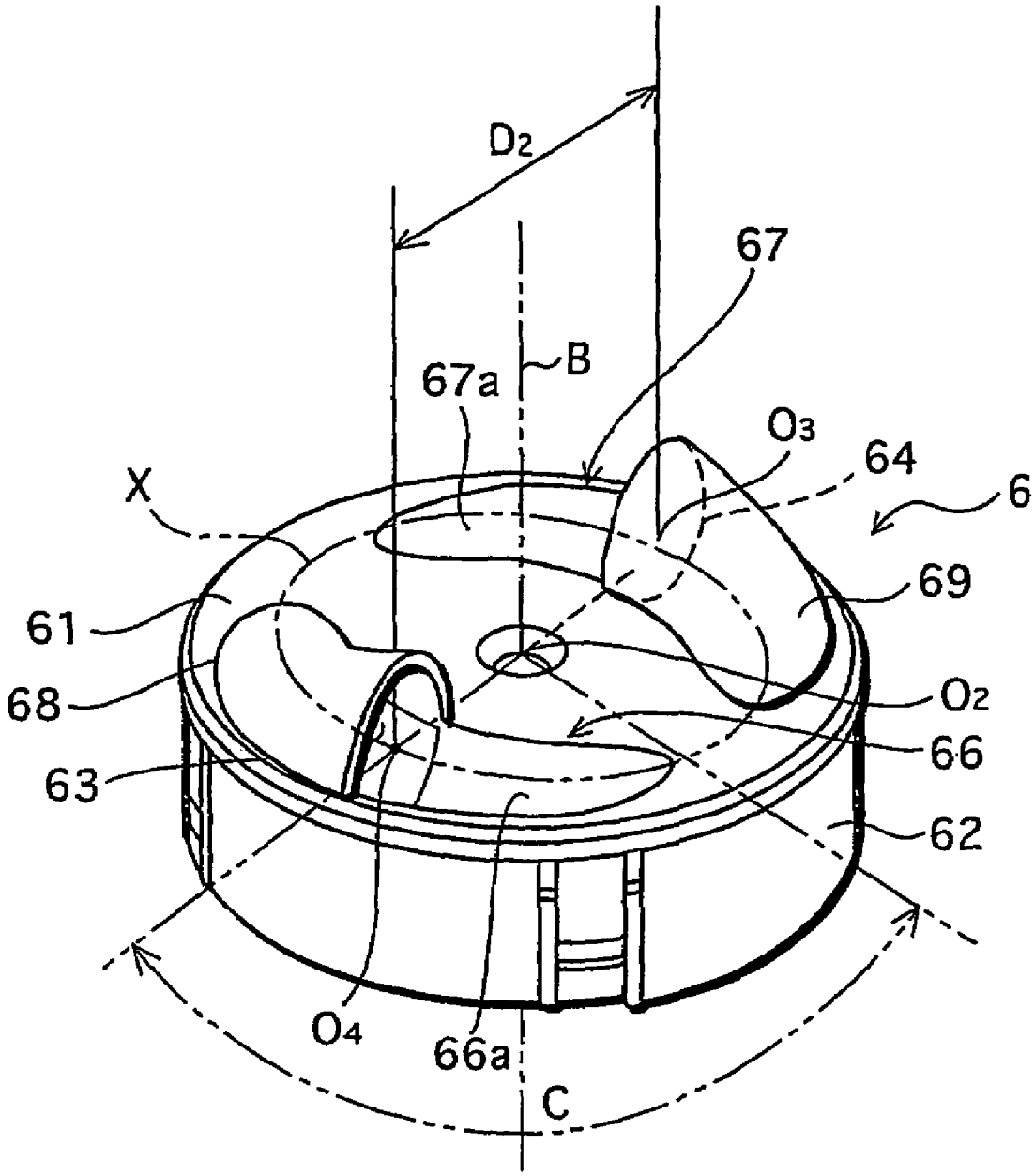
FIG. 4 is a perspective view of a holder according to the first embodiment as viewed diagonally from above.
Figure 5:
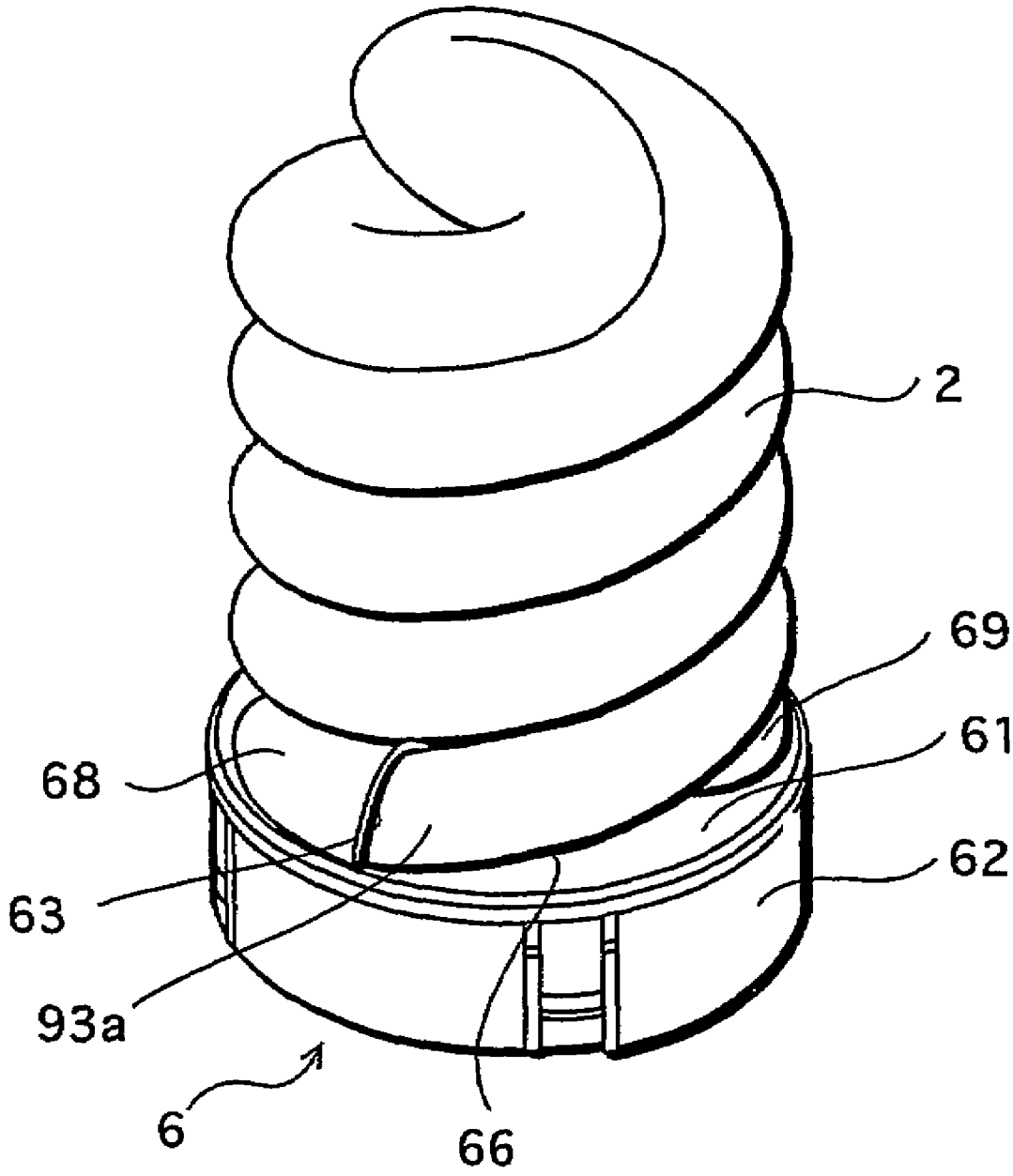
FIG. 5 is a perspective view of the arc tube attached to the holder according to the first embodiment as viewed diagonally from above.
Figure 6:
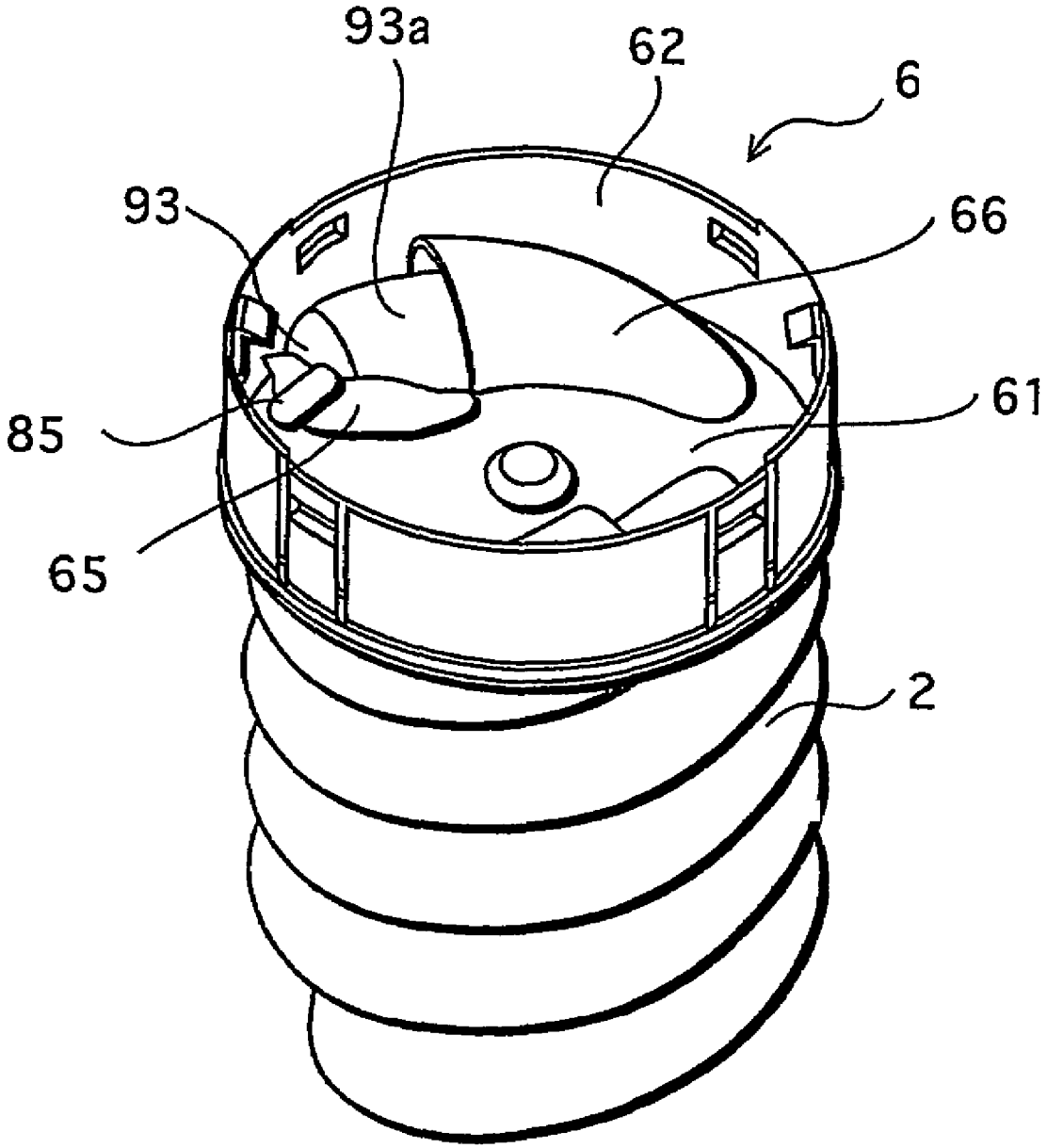
FIG. 6 is a perspective view of the arc tube attached to the holder according to the first embodiment placed upside down, as viewed diagonally from above.

FIG. 4 is a perspective view of the holder 6 as viewed diagonally from above. FIG. 5 is a perspective view of the holder 6 to which the arc tube 2 is attached, as viewed diagonally from above. FIG. 6 is a perspective view of the holder 6 to which the arc tube 2 is attached as viewed diagonally from below.

As shown in FIGS. 4 to 6, the holder 6 is in a cylindrical shape whose one end is closed. The holder 6 has a bottom wall 61 and a peripheral wall 62. The holder 6 has two insertion openings 63 and 64 at the bottom wall 61. The insertion openings 63 and 64 are for allowing the ends 92 and 93 of the arc tube 2 to be inserted therethrough. As shown in FIG. 6, the ends 92 and 93 of the arc tube 2 that have been inserted through the insertion openings 63 and 64 of the holder 6 are bonded via a bonding agent 65 such as silicone. In this way, the arc tube 2 is held by the holder 6.

Here, in the front view of the insertion openings 63 and 64 viewed in the direction where the ends 92 and 93 are moved (a track to be drawn by the ends 92 and 93) when the ends 92 and 93 of the arc tube 2 are inserted into the holder 6 through the insertion openings 63 and 64, an "area in short of the insertion opening in the direction where the ends 92 and 93 are moved" is assumed to be an "area-before the insertion opening", and an "area beyond the insertion opening in the direction where the ends 92 and 93 are moved" is assumed to be an "area after the insertion opening".

It should be noted here that the bottom wall 61 is substantially perpendicular to a central axis "B" of the peripheral wall 62 (hereafter referred to as the "central axis "B" of the holder 6"), in such a manner that a center "O2" of the bottom wall 61 is positioned on the central axis "B" of the holder 6. Also, the arc tube 2 is held by the holder 6 with the spiral axis "A" of the arc tube 2 substantially matching the central axis "B" of the holder 6.

As shown in FIG. 4, the insertion openings 63 and 64 are in a circular shape corresponding to the outer shape of the ends 92 and 93, so as to allow the ends 92 and 93 to be inserted therethrough. The insertion openings 63 and 64 are formed on a plane perpendicular to the bottom wall 61.

The centers "O3" and "O4" of the insertion openings 63 and 64 are positioned on a track "X" to be drawn on a plane by the centers of cross sections of the ends 92 and 93 of the arc tube 2 when the arc tube 2 is rotated in the spiral direction (to right in FIG. 4) with the spiral axis "A" of the arc tube 2 matching the central axis "B" of the holder 6.

To be more specific, a distance between the centers "O3" and "O4" of the insertion openings 63 and 64 via the central axis "B" of the holder 6 (a distance "$D_2$" in FIG. 4) is equal to a diameter of the arc tube 2 formed by the glass tube 9 being wound around the spiral axis "A" (a diameter "$D_1$" in FIG. 3).

The centers "O3" and "O4" of the insertion openings 63 and 64 are positioned at substantially the middle of the bottom wall 61 in its thickness direction, on a plane parallel to the surface of the bottom wall 61. Each of the insertion openings 63 and 64 is formed in such a manner that an upper half of its periphery protrudes in a semi-circular shape from the bottom wall 61 and a lower half of its periphery recesses in a semi-circular shape from the bottom wall 61.

In areas before the insertion openings 63 and 64, guide grooves 66 and 67 are formed. The guide grooves 66 and 67 are provided for guiding the ends 92 and 93 of the arc tube 2 toward the insertion openings 63 and 64 while preventing deviation of the ends 92 and 93 of the arc tube 2. To insert the ends 92 and 93 of the arc tube 2 into the holder 6, the end portions 92*a* and 93*a* are first placed to come in contact with the guide grooves 66 and 67. In this state, the arc tube 2 is then rotated around the spiral axis "A" in the spiral direction, so that the ends 92 and 93 of the arc tube 2 are guided to the insertion openings 63 and 64 by the guide grooves 66 and 67. It should be noted here that the guide grooves 66 and 67 correspond to the "insertion-guiding unit" referred to in the claims of the present invention.

The guide grooves 66 and 67 are formed in the spiral direction, in correspondence with the outer shape of the end portions 92*a* and 93*a* that have been wound in a double spiral. The guide grooves 66 and 67 are continuous to the lower halves of the peripheries of the insertion openings 63 and 64. To be more specific, the guide grooves 66 and 67 have the same semi-circular cross sections as the semi-circular cross sections of the lower parts of the end portions 92*a* and 93*a* of the arc tube 2, and allow the lower parts of the end portions 92*a* and 93*a* of the arc tube 2 to come in contact. It should be noted here that the surfaces of the guide grooves 66 and 67 with which the end portions 92*a* and 93*b* come in contact are referred to as the "contact surfaces 66*a* and 67*a*". The guide grooves 66 and 67 are formed deeper as they are closer to the insertion openings 63 and 64.

To be more specific, the guide grooves 66 and 67 have the contact surfaces 66*a* and 67*a* being wound in the same manner as that for the end portions 92*a* and 93*a* of the arc tube 2, i.e., wound around the central axis "B" of the holder 6 at the spiral angle "β".

On the other hand, in areas after the insertion openings 63 and 64, covering units 68 and 69 are formed. The covering units 68 and 69 are provided for covering the ends 92 and 93 and the end portions 92*a* and 93*a* of the arc tube 2 inserted in the holder 6. As shown in FIG. 4, the covering units 68 and 69 are continuous from the upper halves of the peripheries of the insertion openings 63 and 64, and extend in the spiral direction of the end portions 92*a* and 93*a* of the arc tube 2. The covering units 68 and 69 and are each formed in the shape of an arch.

To be more specific, the covering units 68 and 69 have the semi-circular cross sections corresponding to the semi-circular cross sections of the upper parts of the end portions 92*a* and 93*a* of the arc tube 2, and allow the upper parts of the end portions 92*a* and 93*a* of the arc tube 2 to be fit therein. The arches of the covering units 68 and 69 are formed lower as they are less closer to the insertion openings 63 and 64.

2. Processes for Assembling Compact Self-ballasted Fluorescent Lamp

Figure 7C:
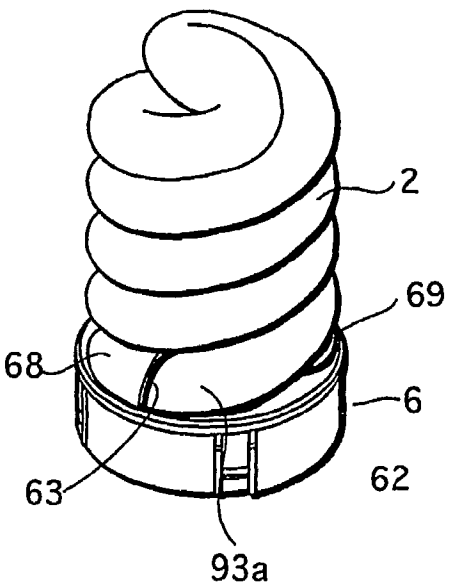
FIGS. 7A to 7C are diagrams for explaining processes for attaching the arc tube to the holder according to the first embodiment.
Figure 7B:
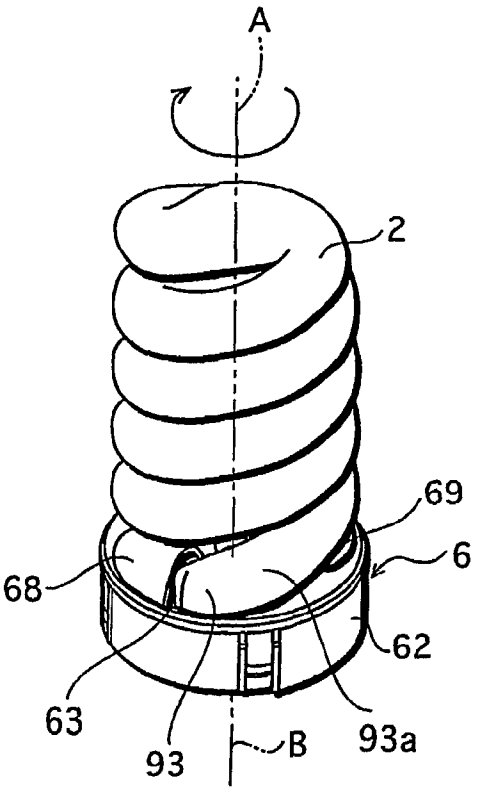
Figure 7A:
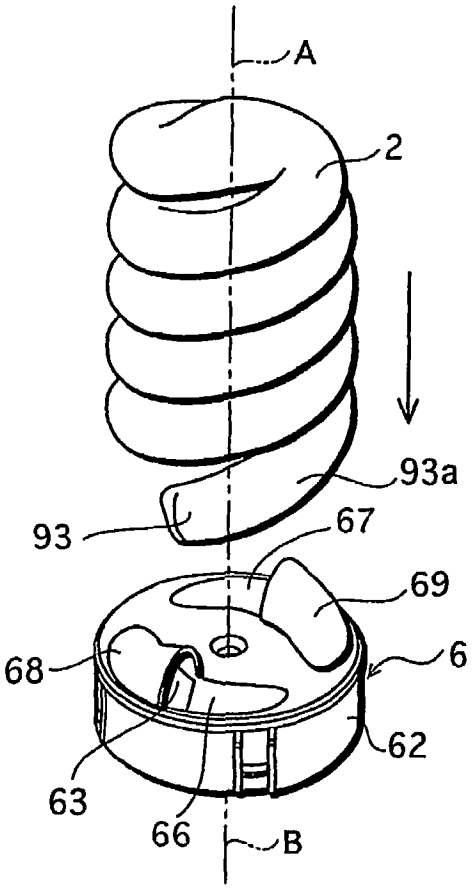

The following describes processes for assembling the compact self-ballasted fluorescent lamp 1 with the above-described construction, in particular, the processes for attaching the arc tube 2 to the holder 6. FIGS. 7A to 7C are diagrams for explaining the processes for inserting the arc tube 2 into the holder 6 through the insertion openings 63 and 64.

First, the arc tube 2 with a double-spiral structure and the holder 6 for holding the arc tube 2 are prepared. The arc tube 2 and the holder 6 are aligned so that the spiral axis "A" of the arc tube 2 substantially matches the central axis "B" of the holder 6, and the ends 92 and 93 of the arc tube 2 are positioned above the insertion openings 63 and 64 in the direction of the central axis "B". The arc tube 2 is then moved toward the holder 6 along the central axis "B" of the holder 6 in the direction indicated by an arrow shown in FIG. 7A, and the arc tube 2 is placed on the holder 6 in such a manner that the end portions 92*a* and 93*a* are fit in the guide grooves 66 and 67.

Here, the lower parts of the end portions 92*a* and 93*a* of the arc tube 2 are in contact with the contact surfaces 66*a* and 67*a* of the guide grooves 66 and 67. Because the guide grooves 66 and 67 are formed to have the contact surfaces 66*a* and 67*a* along the lower parts of the end portions 92*a* and 93*a* of the arc tube 2, the arc tube 2 can be placed stably on the holder 6.

Also, the guide groove 66 (or 67) is provided in an area before the insertion opening 63 (or 64) so as to extend in a wide range "C" (see FIG. 4) from the insertion opening 63 (or 64) to a position of about ⅓ of one wind around the central axis "B" of the holder 6. Therefore, the end portions 92*a* and 93*a* of the arc tube 2 can be easily placed on the guide grooves 66 and 67.

Next, the arc tube 2 placed on the holder 6 is rotated around the spiral axis "A" in the spiral direction indicated by an arrow in FIG. 7B, so that the ends 92 and 93 of the arc tube 2 are moved toward the insertion openings 63 and 64 along the guide grooves 66 and 67. As shown in FIG. 7C, the ends 92 and 93 of the arc tube 2 are finally inserted into the holder 6 through the insertion openings 63 and 64.

Here, the guide grooves 66 and 67 are formed as continuous to the insertion openings 63 and 64 in the spiral direction of the end portions 92*a* and 93*a* of the arc tube 2. By such guide grooves 66 and 67, the ends 92 and 93 of the arc tube 2 are guided to the insertion openings 63 and 64 and smoothly inserted into the holder 6 through the insertion openings 63 and 64, simply by rotating the arc tube 2 around the spiral axis "A" matching the central axis "B" of the holder 6. During the insertion, the positional deviation of the arc tube 2 placed on the guide grooves 66 and 67 is also prevented. In this way, the conventional problem of difficulties in inserting ends of an arc tube into the insertion openings 963 and 964 of the holder 906 can be solved.

As described above, the ends 92 and 93 of the arc tube 2 can be inserted into the holder 6 through the insertion openings 63 and 64 simply by rotating the arc tube 2 around the spiral axis "A" after placing the end portions 92*a* and 93*a* of the arc tube 2 on the guide grooves 66 and 67 of the holder 6. Therefore, automation of this process becomes possible.

Further, in the compact self-ballasted fluorescent lamp 1 in which the arc tube 2 is attached to the holder 6 with the above-described construction, the end portions 92*a* and 93*a* of the arc tube 2 are covered by the covering units 68 and 69. This means that electrodes and the like sealed at the ends 92 and 93 of the arc tube 2 can also be covered up.

3. Others i) Covering Unit

Although the first embodiment describes the case where the covering units 68 and 69 are formed in the areas after the insertion openings 63 and 64 of the holder 6, the covering units 68 and 69 may not necessarily be provided. This is because easy insertion of the arc tube 2 into the holder 6 through the insertion openings 63 and 64 only requires the guide grooves 66 and 67 formed in the areas before the insertion openings 63 and 64.

Figure 8:
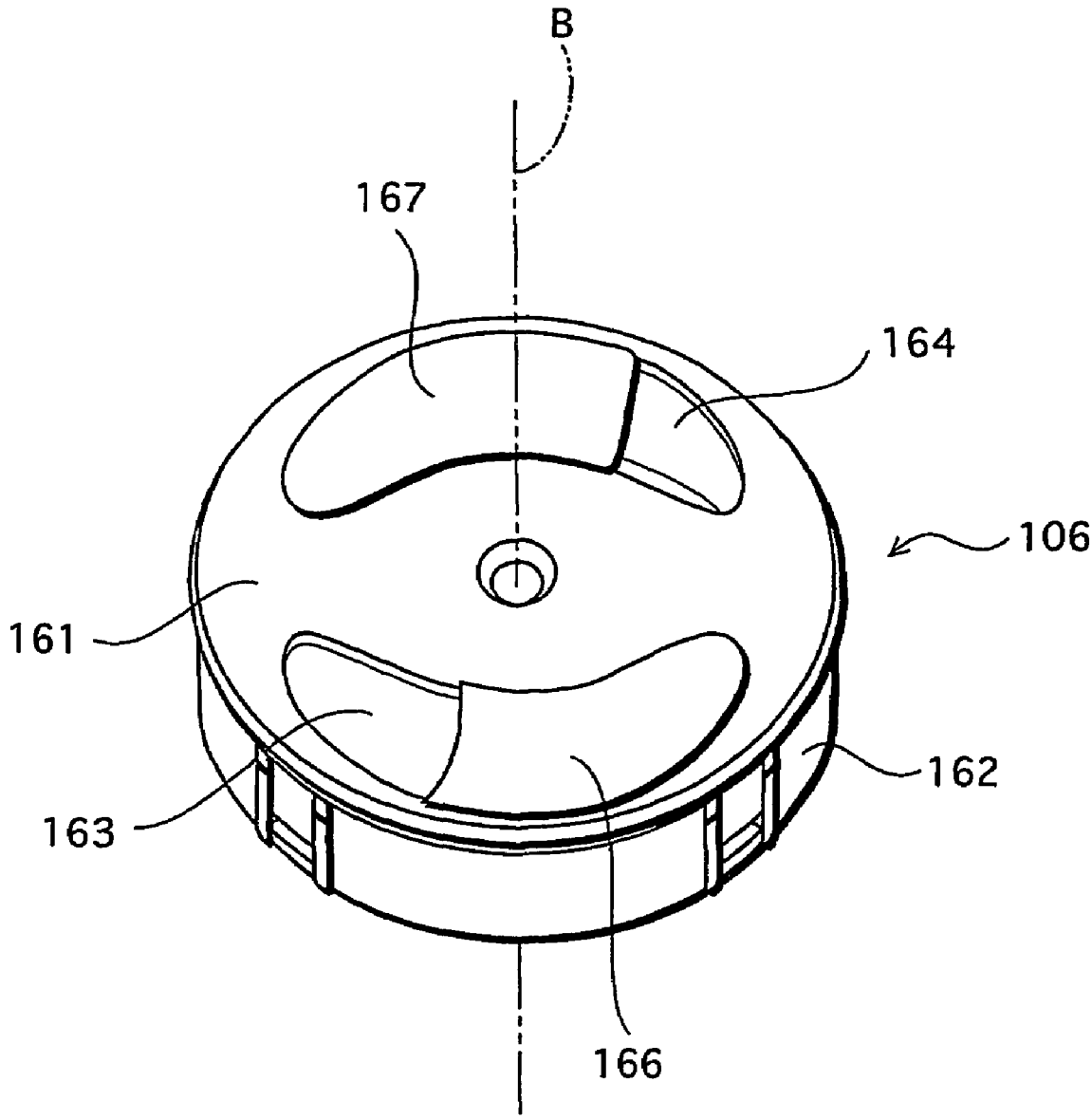
FIG. 8 is a perspective view of a holder according to a modification of the first embodiment.

FIG. 8 is a perspective view of a holder in which covering units are not provided.

As shown in the figure, the holder 106 has, at its bottom wall 161, insertion openings 163 and 164 and guide grooves 166 and 167. The guide grooves 166 and 167 have the same constructions as the guide grooves 66 and 67 described in the first embodiment. The insertion openings 163 and 164 are composed of openings formed in the bottom wall 161 by removing the covering units 68 and 69 described in the first embodiment and openings corresponding to the insertion openings 63 and 64 described in the first embodiment formed at the edges of the guide grooves 66 and 67.

The holder 106 does not have covering units (68 and 69), and therefore can have the bottom wall 161 being flat without any recession and protrusion. Such a flat bottom wall can represent an improvement in the design. In this case where the covering units are not provided, however, the end portions 92*a* and 93*a* of the arc tube 2 need to be inserted into the holder 106 to such a degree that enables electrodes sealed at the ends 92 and 93 to be covered up.

ii) Guide Groove (Shape of Cross Section)

The first embodiment describes the case where the guide grooves 66 and 67 have the contact surfaces 66*a* and 67*a* with which the lower parts of the end portions 92*a* and 93*a* of the arc tube 2 come in contact, and such guide grooves 66 and 67 prevent the positional deviation of the arc tube 2 in a direction perpendicular to the spiral axis "A" (horizontal direction) when the arc tube 2 is rotated for its attachment. However, the lower parts of the end portions 92*a* and 93*a* of the arc tube 2 may not necessarily come in contact with substantially the entire guide grooves 66 and 67, as long as the guide grooves 66 and 67 can prevent the positional deviation of the arc tube 2 in the direction perpendicular to the spiral axis "A" when the arc tube 2 is rotated.

For example, the guide grooves 66 and 67 may be formed to have a cross section in a rectangular shape or a V-shape. The guide grooves 66 and 67 may further be formed to have a semi-circular cross section that is partially the same as the semi-circular cross section of the lower parts of the end portions 92*a* and 93*a* of the arc tube 2. The guide grooves 66 and 67 having cross sections of any of the above shapes can also guide the ends 92 and 93 of the arc tube 2 to the insertion openings 63 and 64.

(Shape of Vertical Section)

The first embodiment describes the case where the guide grooves 66 and 67 have the contact surfaces 66*a* and 67*a* that are continuous in the spiral direction along the end portions 92*a* and 93*a* of the arc tube 2, so that the guide grooves 66 and 67 can guide, without deviation, the ends 92 and 93 of the arc tube 2 toward the insertion openings 63 and 64 in the spiral direction when the arc tube 2 is rotated around the spiral axis "A".

However, the guide grooves 66 and 67 do not need to have the contact surfaces 66*a* and 67*a* that are continuous in the spiral direction, as long as the guide grooves 66 and 67 enable the arc tube 2 before being inserted into the holder 6 to be placed thereon in a stable manner and can guide without deviation the ends 92 and 93 toward the insertion openings 63 and 64 in the spiral direction when the arc tube 2 is rotated around the spiral axis "A".

As one example, the guide grooves 66 and 67 may have discontinues contact surfaces with which the end portions 92*a* and 93*a* of the arc tube 2 before being inserted into the holder 6 come in contact at two or more positions thereof in the spiral direction. In this case, the end portions 92*a* and 93*a* of the arc tube 2 need to keep in contact with the contact surfaces at two or more positions thereof while the arc tube 2 is being rotated.

As a specific example of such, the guide grooves 66 and 67 may be provided with contact parts arranged at certain intervals for allowing the end portions 92*a* and 93*a* of the arc tube 2 to come in contact. In this case, too, the same effects as produced by the continuous contact surfaces 66*a* and 67*a* described above can be produced.

iii) Insertion Opening

The first embodiment describes the case where the insertion openings 63 and 64 formed at the bottom wall 61 of the holder 6 are in such a circular shape corresponding to the outer shape of the ends 92 and 93 of the arc tube 2. In the case of the arc tube 2 whose ends have an outer shape different from the shape described in the first embodiment, it is preferable to form the insertion openings 63 and 64 in such a shape determined accordingly.

However, the shape of the insertion openings 63 and 64 may not necessarily be the same as the outer shape of the ends 92 and 93 of the arc tube 2, as long as the insertion openings 63 and 64 allow the ends 92 and 93 of the arc tube 2 to be inserted therethrough into the holder 6.

One specific example is a case where the outer shape of the ends 92 and 93 and the end portions 92*a* and 93*a* of the arc tube 2 is circular and the shape of the insertion openings is substantially square with its one side being a diameter of the circular outer shape of the ends 92 and 93 and the end portions 92*a* and 93*a* of the arc tube 2.

In this case, however, gaps larger than necessary are formed between the corners of the insertion openings and the end portions 92*a* and 93*a* of the arc tube 2 inserted therethrough. The bonding agent 65 may flow through these gaps when the ends 92 and 93 of the arc tube 2 are bonded to the holder 6.

Also, although a plane on which the insertion openings 63 and 64 are provided is perpendicular to the bottom wall 61 and includes the central axis "B" thereon, the plane where the insertion openings 63 and 64 are provided may not necessarily include the central axis "B" thereon. As one example, the plane where the insertion openings 63 and 64 are provided may be a plane forming a predetermined angle with respect to the radius direction of the bottom wall 61.

Further, although the first embodiment describes the case where the centers of the insertion openings 63 and 64 are positioned at substantially the middle of the bottom wall 61 in its thickness direction, on a plane substantially parallel to the surface of the bottom wall 61, the positions of the centers of the insertion openings 63 and 64 in the direction of the central axis "B" may not necessarily be the same as the position of the bottom wall 61, as long as the guide grooves 66 and 67 are provided to extend toward the insertion openings 63 and 64 in the spiral direction of the end portions 92*a* and 93*a* of the arc tube 2. For example, the insertion openings 63 and 64 may entirely protrude from the bottom wall 61, or may be entirely embedded below the bottom wall 61.

Second Embodiment

The inventors of the present application examined the construction of the holder 6 that enables the ends 92 and 93 of the arc tube 2 to be easily inserted into the holder 6, and the method for attaching the arc tube 2 to the holder 6. As a result, the inventors discovered that the holder 6 in which the guide grooves 66 and 67 are provided in the areas before the insertion openings 63 and 64 enable the ends 92 and 93 of the arc tube 2 to be easily inserted into the holder 6 as described in the first embodiment.

However, the inventors found difficulties in attaching the arc tube 2 to the holder 6 described in the first embodiment, when the arc tube 2 has lead wires 7*a*, 7*b*, 8*a*, and 8*b* that are for supporting coil electrodes and extend from the ends 92 and 93. To be specific, the inventors found difficulties in inserting the lead wires 7*a*, 7*b*, 8*a*, and 8*b* smoothly through the insertion openings 63 and 64 of the holder 6.

The inventors then made preliminarily examinations on the construction of a holder that enables ends of an arc tube from which lead wires for electrodes extend, to be easily inserted into the holder, and also on the method for attaching the arc tube to the holder. As a result, the inventors discovered that the lead wires are inserted relatively easily through the insertion openings by bending the lead wires in a direction parallel to the spiral-axis direction and inserting them through the insertion openings in the spiral-axis direction.

1. Construction of the Holder

Figure 9:
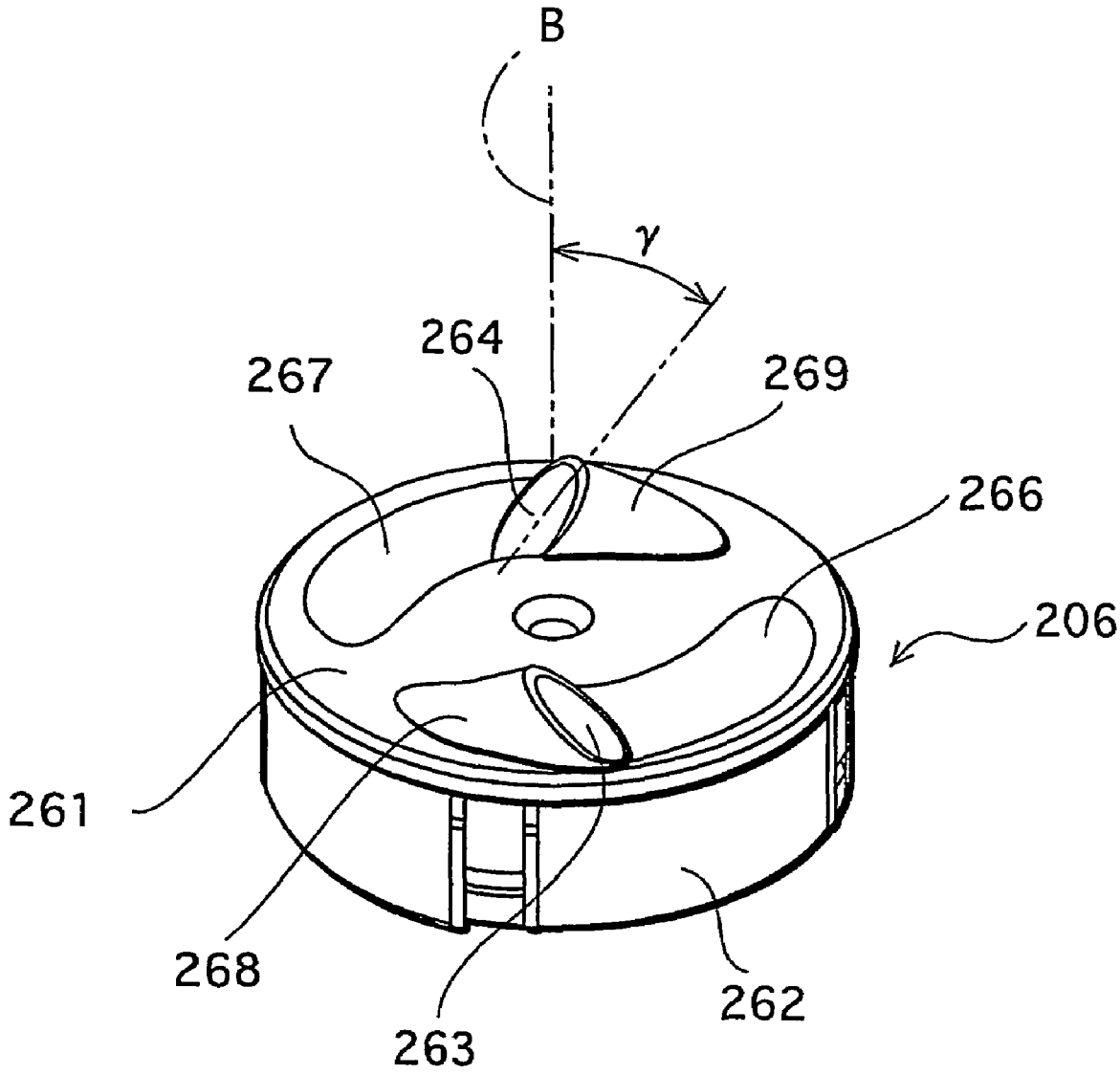
FIG. 9 is a perspective view of a holder according to a second embodiment of the present invention as viewed diagonally from above.

FIG. 9 is a perspective view of a holder that enables lead wires for electrodes to be inserted easily into the holder. This holder 206 results from the preliminary examinations described above. The holder 206 is characterized in that its insertion openings 263 and 264 are formed so as to provide openings as viewed from above, for enabling the lead wires 207*a*, 207*b*, 208*a*, and 208*b* (see FIG. 10) substantially parallel to the central axis "B" of the holder 206, to be easily inserted therethrough when the arc tube 202 is attached to the holder 206.

The insertion openings 263 and 264 of the holder 206 are inclined so that their upper parts are shifted in the direction where the covering units 268 and 269 are provided. To be specific, the insertion openings 263 and 264 are formed in such a manner that a plane where the insertion opening is provided is inclined at an angel "γ", e.g., 40° with respect to the central axis "B" of the holder 206 as shown in FIG. 9. As viewed from above in the direction of the central axis "B" in FIG. 9, the insertion openings 263 and 264 are formed to provide openings between the covering units 268 and 269 and the guide grooves 266 and 267.

2. Attachment Processes

Figure 10B:
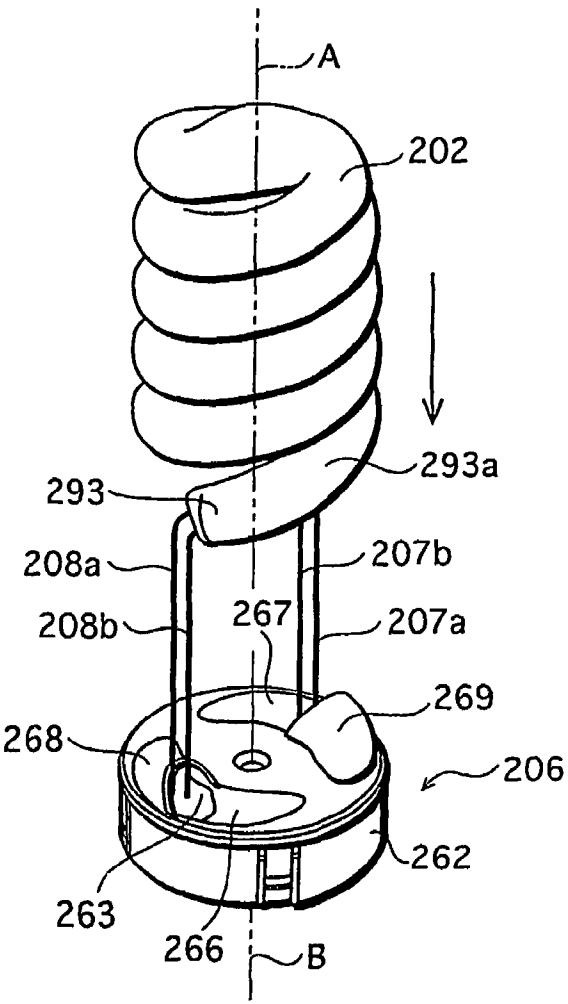
FIGS. 10A and 10B are diagrams for explaining processes for attaching the arc tube to the holder according to the second embodiment.
Figure 10A:
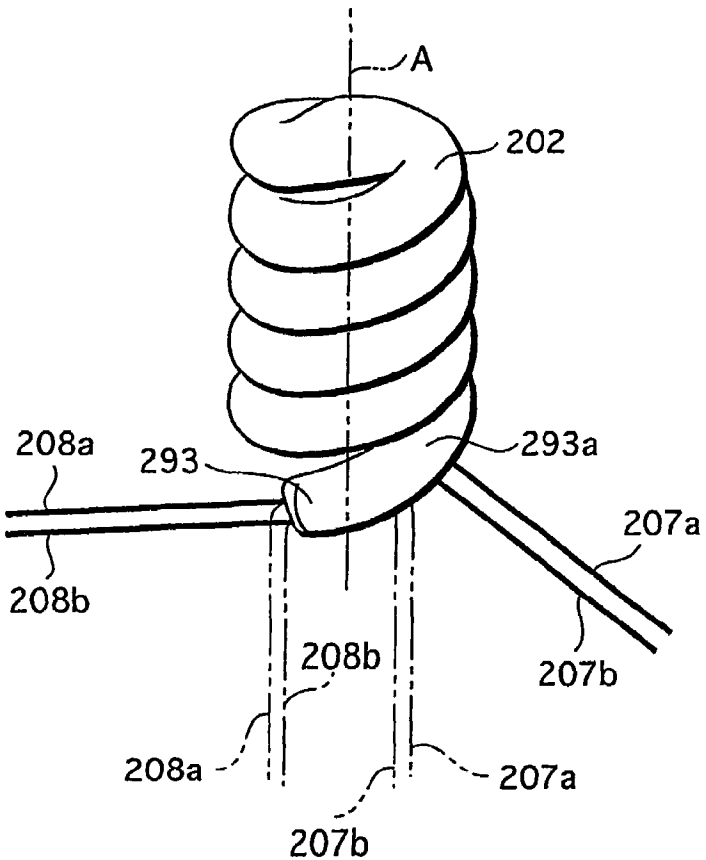

FIGS. 10A and 10B are diagrams for explaining processes for attaching an arc tube having lead wires for electrodes, to a holder. First, the lead wires 207*a*, 207*b*, 208*a*, and 208*b* indicated by bold lines in FIG. 10A extending from the ends 293 (and 294) of the arc tube 202 are bent to the side opposite to the turning portion 91 in a direction parallel to the spiral-axis direction ("A" in the figure) of the arc tube 202, at positions close to the ends 293 (and 294) of the arc tube 202. The lead wires 207*a*, 207*b*, 208*a*, and 208*b* after being bent are indicated by interrupted lines in FIG. 10A.

Following this, the arc tube 202 and the holder 206 are aligned so that the spiral axis "A" of the arc tube 202 substantially matches the central axis "B" of the holder 206, and that the lead wires 207*a*, 207*b*, 208*a*, and 208*b* are positioned to enter in the openings formed between the covering units 268 and 269 and the guide grooves 266 and 267 of the holder 206 as viewed from above. Then, the arc tube 202 is moved toward the holder 206 in the direction indicated by an arrow in FIG. 10B, i.e., in the direction of the spiral axis "A". Here, the arc tube 202 is moved while its aligned position in a direction perpendicular to the spiral axis "A" is being maintained.

Here, the insertion openings 263 and 264 of the holder 206 are inclined with respect to the spiral axis "A" of the arc tube 202 (the central axis "B" of the holder 206). As viewed from above, therefore, the insertion openings 263 and 264 provide the openings formed between the covering units 268 and 269 and the guide grooves 266 and 267. The lead wires 207*a*, 207*b*, 208*a*, and 208*b* bent to be substantially parallel to the spiral axis "A" can be easily inserted into the holder 206 through such openings formed between the covering units 268 and 269 and the guide grooves 266 and 267 as shown in FIG. 10B.

The arc tube 202 is further moved toward the holder 206, so that the end portions 293*a* (and 294*a*) of the arc tube 202 are fit in the guide grooves 266 and 267 of the holder 206. The subsequent processes are the same as the processes described in the first embodiment.

3. Others i) Inclination of Insertion Opening

Although the second embodiment describes the case where the insertion openings 263 and 264 are inclined at an angle of 40° ("β" in the figure) with respect to the central axis "B" of the holder 206 as show in FIG. 9, the angle of inclination "γ" should not be limited to 40°. The angle of inclination "γ" may be set at any value smaller than 90°. However, it is preferable that the angle "λ" is in a range of 20 to 60° inclusive.

This range is determined due to the following reason. When the angel "λ" is smaller than 20°, the openings formed between the covering units 268 and 269 and the guide grooves 266 and 267 are so small that inserting the lead wires 207*a*, 207*b*, 208*a*, and 208*b* into the holder 206 through the openings becomes difficult.

On the other hand, when the angel "λ" is larger than 60° the bonding agent used for bonding the ends 293 and 294 of the arc tube 202 to the holder 206 may flow through the insertion openings 263 and 264.

Also, although the second embodiment describes the case where the insertion openings 263 and 264 are formed in such a manner that the upper halves thereof (the peripheries of the ends of the covering units 268 and 269) and the lower halves thereof (the peripheries of the ends of the guide grooves 266 and 267) are inclined at the same angles with respect to the central axis "B" of the holder 206, only the upper halves or the lower halves of the insertion openings 263 and 264 may be inclined with respect to the central axis "B" of the holder 206, or the upper halves and the lower halves of the insertion openings 263 and 264 may be inclined at different angles with respect to the central axis "B" of the holder 206.

ii) Modification of the Second Embodiment

The second embodiment describes the case where the insertion openings 263 and 264 are inclined so as to provide openings between the covering units 268 and 269 and the guide grooves 266 and 267 as viewed from above, for the purpose of enabling the lead wires 207*a*, 207*b*, 208*a*, and 208*b* to be easily inserted into the holder 206 through the insertion openings 263 and 264. However, the covering units 268 and 269 and the guide grooves 266 and 267 may have other constructions to provide openings between them.

Figure 11:
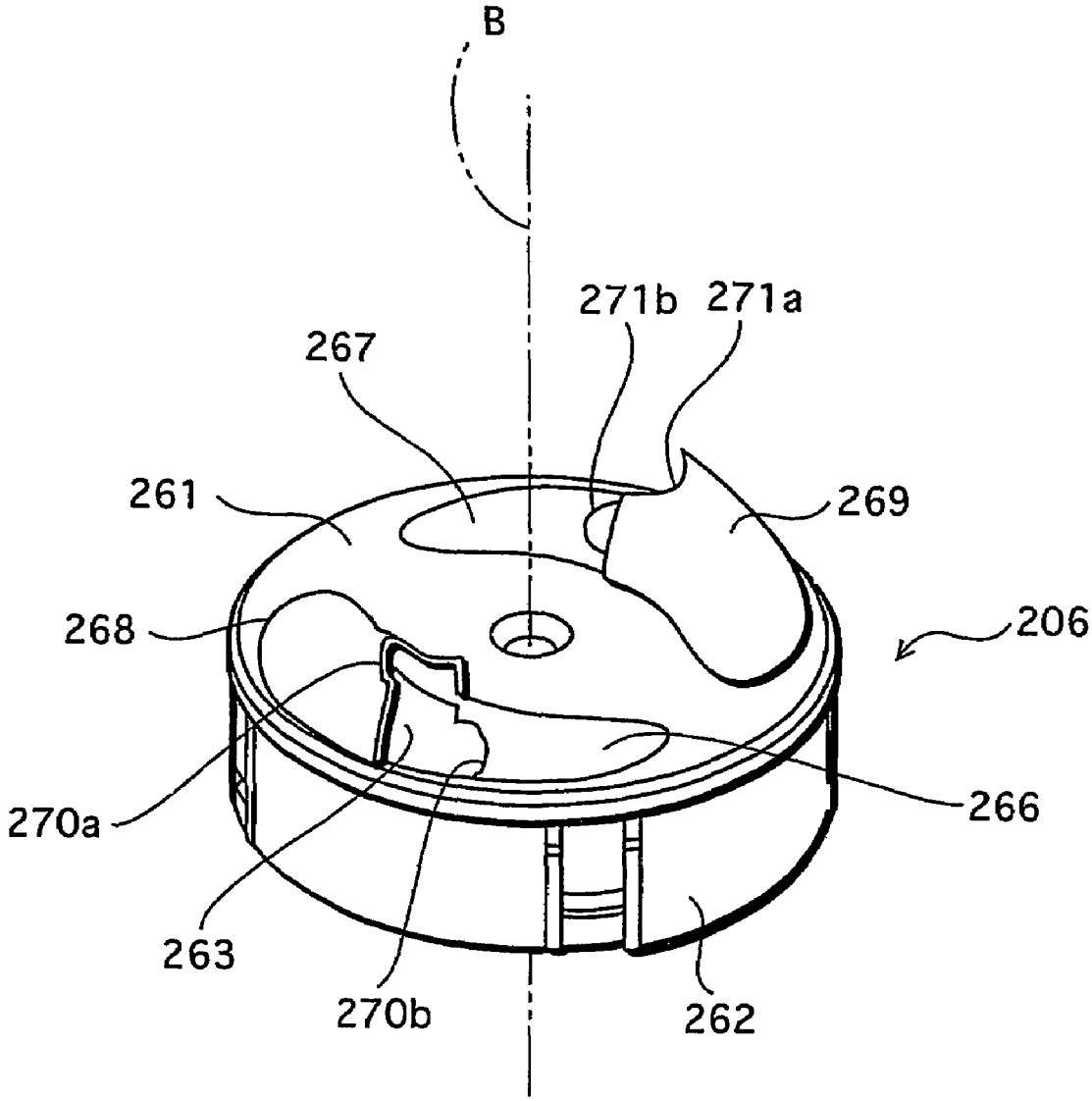
FIG. 11 is a perspective view of a holder according to a modification of the second embodiment.

FIG. 11 is a perspective view of a holder having notches formed in the vicinity of its insertion openings. As shown in the figure, the holder 206 has notches 270*a*, 270*b*, 271*a*, and 271*b* formed in the covering units 268 and 269 and the guide groves 266 and 267, so as to widen the insertion openings 263 and 264 as viewed from above in the direction of the central axis "B". In the case of this holder 206 as in the second embodiment, the lead wires 207*a*, 207*b*, 208*a*, and 208*b* extending from the ends 293 and 294 of the arc tube 202 can be easily inserted into the holder 206 by bending the lead wires 207*a*, 207*b*, 208*a*, and 208*b* in parallel with the spiral axis "A" of the arc tube 202.

Also, although the present modification describes the case where the notches 270*a* and 271*a* are formed in the covering units 268 and 269 and the notches 270*b* and 271*b* are formed in the guide grooves 266 and 267, notches may be formed only in the covering units 268 and 269 or in the guide grooves 266 and 267. In either case, however, the total area of the notches formed is to be substantially the same as the total area of the notches 270*a*, 270*b*, 271*a*, and 271*b* formed in the covering units 268 and 269 and the guide grooves 266 and 267, so that the lead wires 207*a*, 207*b*, 208*a*, and 208*b* can be easily inserted into the holder 206.

Although the notches 270*a*, 270*b*, 271*a*, and 271*b* are each formed to have substantially a semi-circular shape as viewed from above in the direction of the central axis "B" in FIG. 11, the notches 270*a*, 270*b*, 271*a*, and 271*b* may be each formed to have another shape such as a V-shape and a rectangular shape as viewed from above.

Further, slits may be formed instead of the notches 270*a*, 270*b*, 271*a*, and 271*b*. In this case, too, the same effects as produced by the notches 270*a*, 270*b*, 271*a*, and 271*b* can be produced, although inserting the lead wires 207*a*, 207*b*, 208*a*, and 208*b* therethrough becomes more difficult in the case where the slits are provided.

Also, the above examples and the second embodiment may be combined. For example, the insertion openings 263 and 264 may be formed in such a manner that the upper halves of their peripherals are inclined with respect to the central axis "B" of the holder 206, and the notches 270*b* and 271*b* are formed in the guide grooves 266 and 267.

Third Embodiment

The inventors of the present application examined the construction of the holder that enables the ends of the arc tube to be easily inserted therein and the method for attaching the arc tube to the holder (first embodiment), and the construction of the holder 206 that enables the lead wires 207*a*, 207*b*, 208*a*, and 208*b* extending from the ends 293 and 294 of the arc tube 202 to be smoothly inserted therein and the method for attaching the arc tube 202 to the holder 206 (second embodiment).

As a result, the inventors came up with the idea to provide the guide grooves 66 and 67 in the areas before the insertion openings 63 and 64 of the holder 6, and the idea to widen the insertion openings 263 and 264 as viewed from above, as described in the first and second embodiments.

However, the inventors are encountered with a new problem that the bonding agent cannot be injected by a sufficient amount between (a) the holder 206 and (b) the ends and the end portions of the arc tube 202, when the ends of the arc tube 202 inserted in the holder 206 are bonded to the holder 206 via the bonding agent.

Figure 12:
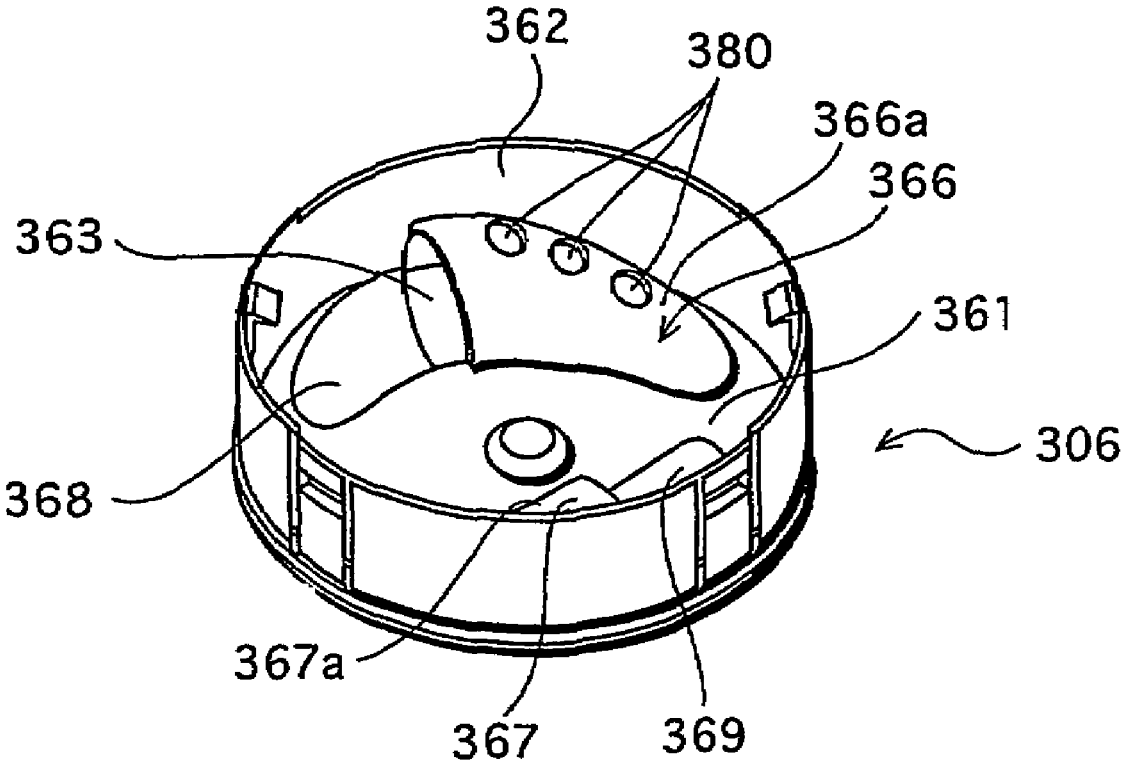
FIG. 12 is a perspective view of a holder according to a third embodiment of the present invention placed upside down, as viewed diagonally from above.

FIG. 12 is a perspective view of a holder that enables the bonding agent to be injected by a sufficient amount in an area where the arc tube and the holder are bonded together. As shown in the figure, the holder 306 in the present embodiment has a plurality of, e.g, three, inlets 380 at bottoms 366*a* and 367*a* of the guide grooves 366 and 367. The inlets 380 are provided for injecting the bonding agent between the end portions of the arc tube and the surfaces (with which the arc tube comes in contact) of the guide grooves 366 and 367.

It should be noted here that because the holder 306 is placed upside down in FIG. 12, the guide grooves 366 and 367 are each viewed in the shape of an arch, and also that the inlets formed in the guide groove 367 are not shown in the figure as hidden by a peripheral wall 362.

This construction ensures that the bonding agent is injected by a sufficient amount between the surfaces of the guide grooves 366 and 367 and the end portions of the arc tube in contact therewith or opposed thereto, through the inlets 380 formed in the bottoms 366*a* and 367*a* of the guide grooves 366 and 367. This construction ensures that the arc tube and the surfaces of the guide grooves 366 and 367 are bonded firmly together.

Because the three inlets 380 are arranged in the spiral direction of the end portions of the arc tube in the bottoms 366*a* and 367*a* of the guide grooves 366 and 367 of the holder 306, the bonding agent can be filled substantially uniformly in an area where the end portions of the arc tube are in contact with or opposed to the guide grooves 366 and 367.

With this construction, an amount of bonding agent to be injected can be optimized. Further, because the inlets 380 are provided in the bottoms 366*a* and 367*a* of the guide grooves 366 and 367, the inlets 380 cannot be viewed from outside the holder 306 after the arc tube is bonded to the holder 306. Therefore, the inlets 380 do not cause deterioration in the design.

Figure 13:
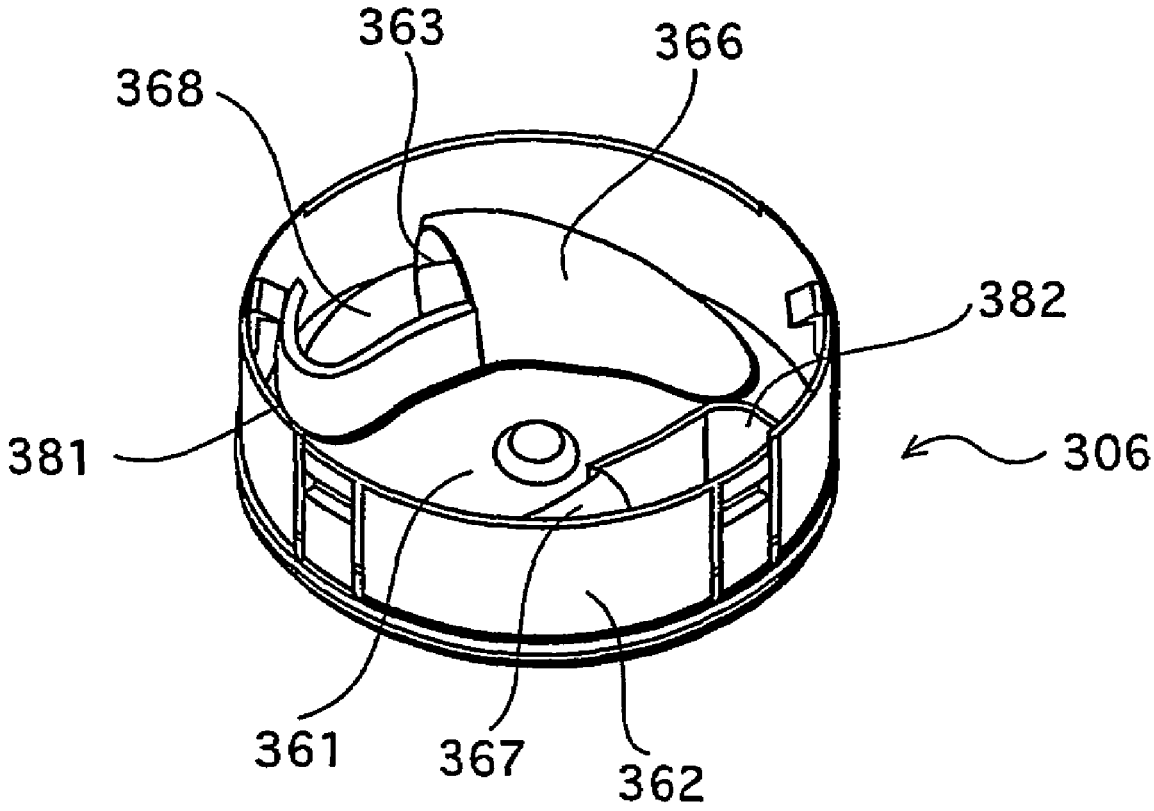
FIG. 13 is a perspective view of a holder according to a modification of the third embodiment.

FIG. 13 is a perspective view of a holder that can also solve the above-described problem. This holder 306 includes enclosure walls 381 and 382 to prevent flowing out of the bonding agent injected in the vicinity of the ends of the arc tube. These enclosure walls 381 and 382 are formed on the back surface of the bottom wall 361 so as to enclose the ends and the end portions of the arc tube inserted in the holder 306.

This construction prevents the bonding agent injected in the vicinity of the ends of the arc tube from flowing toward the center of the back surface of the bottom wall 361, thereby ensuring that the bonding agent blocked in the enclosure walls 381 and 382 firmly bonds the ends and the end portions of the arc tube to the holder 306.

Also, because the enclosure walls 381 and 382 are formed along the ends and the end portions of the arc tube, the arc tube and the enclosure walls 381 and 382 are bonded together via the bonding agent. This enables the arc tube and the holder 306 to be bonded firmly.

It should be noted here that the enclosure walls 381 and 382 come in contact with the arc tube when the ends of the arc tube are inserted in the holder 306. The enclosure walls 381 and 382 therefore also have the function of blocking the insertion of the arc tube. Accordingly, the enclosure walls 381 and 382 enable the arc tube to be inserted into the holder 306 by substantially a uniform distance. Therefore, the enclosure walls 381 and 382 can function as walls to block the insertion of the arc tube even in a case where the bonding agent is not injected in an area enclosed by the enclosure walls 381 and 382.

Fourth Embodiment

The inventors of the present application succeeded in easily attaching the arc tube to the holder and bonding the arc tube and the holder firmly together, by utilizing the holders 6, 206, and 306 described in the first to third embodiments.

However, the inventors were encountered with a new problem when attaching the substrate on which the electronic ballast is mounted to the holder, and connecting the lead wires that extend from the ends of the arc tube to the surface of the substrate where the base is provided. The problem is that the lead wires are crossed or entangled within the holder.

The inventors solved the above problem by providing the holder with supporting units for supporting the lead wires. The following describes the construction of the supporting units.

Figure 14:
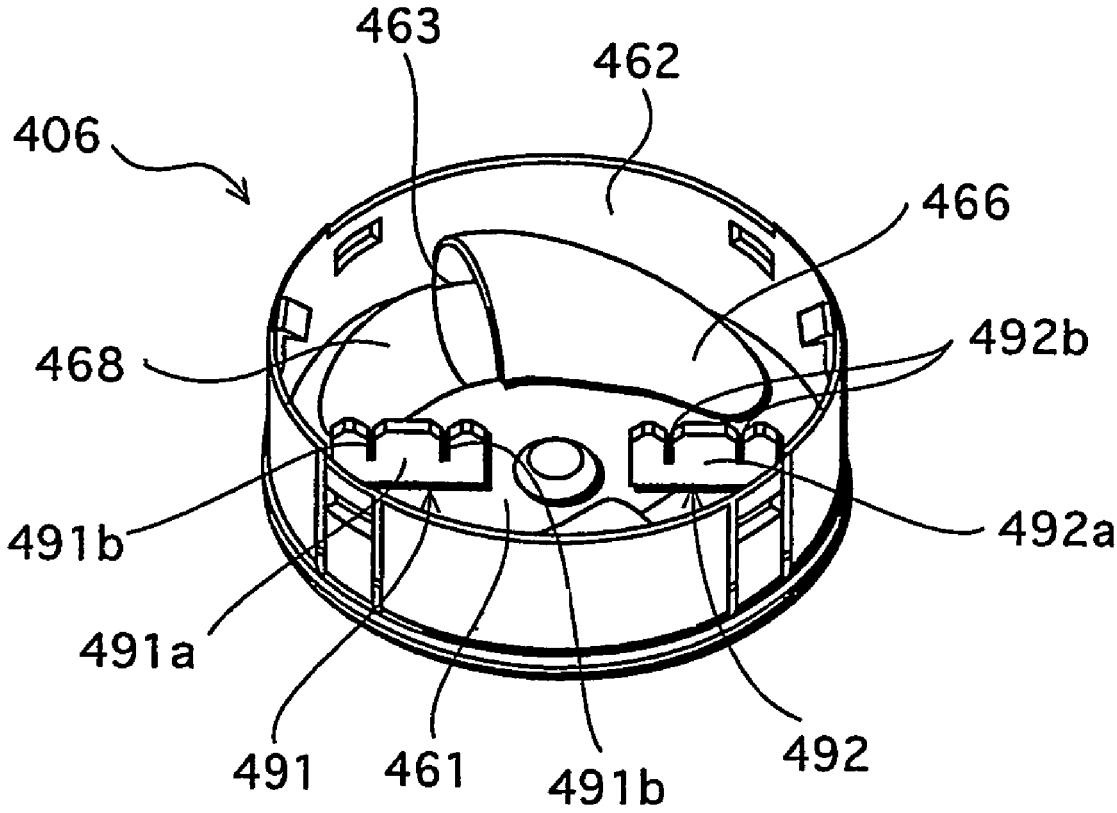
FIG. 14 is a perspective view of a holder according to a fourth embodiment of the present invention placed upside down, as viewed diagonally from above.

FIG. 14 is a perspective view of a holder having such supporting units. As shown in the figure, this holder 406 has supporting units 491 and 492 for supporting lead wires, at the back surface of the bottom wall 461 in the vicinity of the ends of the arc tube inserted in the holder 406.

The supporting unit 491 (or 492) is made up of a supporting base 491*a* (or 492*a*) provided at the back surface of the bottom wall 461, and a pair of supporting slits 491*b* (or 492*b*) formed in the supporting base 491*a* (or 492*a*) for supporting a pair of lead wires.

It should be noted here that the pair of supporting slits 491*b* (or 492*b*) formed in the supporting base 491*a* (or 492*a*) are positioned at a predetermined interval, to support a pair of lead wires with a certain distance being kept between the lead wires.

When the substrate is attached to this holder 406, pairs of lead wires extending from the ends of the arc tube fixed to the holder 406 are first set in the supporting slits 491*b* and 492*b* of the supporting units 491 and 492, in such a manner that the lead wires are not crossed or entangled within the holder 6.

The lead wires supported at the supporting slits 491*b* and 492*b* are then lead outside of the holder 406, in such a manner that the lead wires are not crossed or entangled within the holder 6. After this, the substrate on which the electronic ballast is mounted is attached, for example, to the peripheral wall 462 of the holder 406.

This construction prevents the lead wires from being entangled. Also, because the pairs of lead wires extending from the ends of the arc tube are supported at the supporting slits 491*b* and 492*b* with a certain distance being kept between the lead wires in each pair, the lead wires do not come in contact with each other (i.e. the lead wires are not short-circuited).

Figure 15:
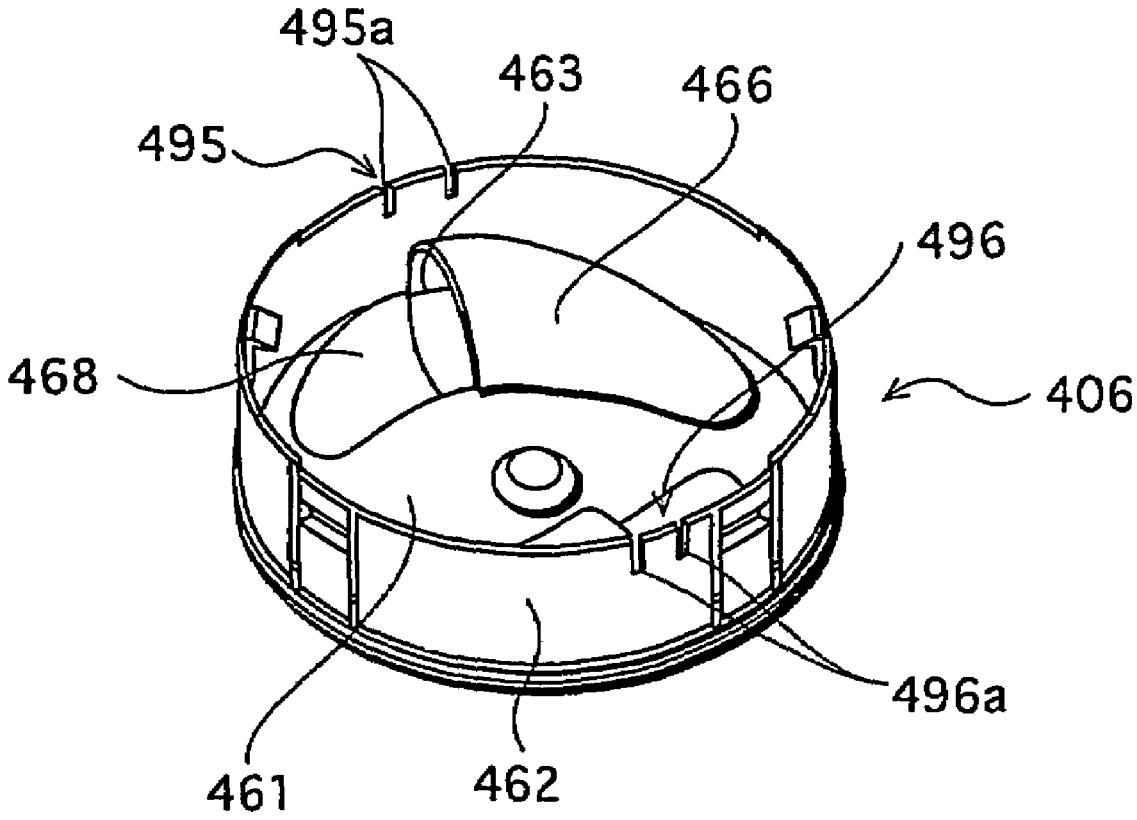
FIG. 15 is a perspective view of a holder according to a modification of the fourth embodiment.

It should be noted here that the supporting units 491 and 492 may not necessarily be formed at the back surface of the bottom wall 461 of the holder 406 but may be formed at other positions. As one example, the supporting units 491 and 492 may be formed directly in the peripheral wall 462 of the holder 406 as that is shown in FIG. 15. In this case, two supporting units 495 and 496 are respectively made up of a pair of supporting slits 495*a* and a pair of supporting slits 496*a* formed in the peripheral wall 462. The supporting slits 495*a* and the supporting slits 496*a* are positioned away from each other, e.g., positioned as opposed to each other with respect to the central axis of the holder 406.

(Modifications)

Although the present invention is described based upon the above embodiments, the contents of the present invention should not be limited to specific examples shown in the above embodiments. For example, the following modifications are possible.

1. Holding Member

Although the above embodiments describe the case where the holding member is made up of a bottom wall and a peripheral wall that are connected together, the holding member may be made up of only a bottom wall. In this case, too, the provision of insertion openings, insertion-guiding units, covering units etc. formed at the bottom wall of the holding member can produce the same effects as produced in the above embodiments.

Although the above embodiments describe the case where the arc tube is held by the holding member (holder) with the spiral axis of the arc tube matching the central axis of the holding member, the arc tube may be held by the holding member with the spiral axis of the arc tube being inclined with respect to the central axis of the holding member.

In this case, for example, the insertion openings, insertion-guiding units, and covering units are formed to be inclined with respect to the central axis of the holding member according to the inclination of the central axis of the bottom wall with respect to the spiral axis of the arc tube. In this case where the arc tube is inclined with respect to the holding member holding the arc tube, the insertion openings, insertion-guiding units, and covering units can have the same positional relationship as that described in the above embodiments by positioning them based upon the position of the spiral axis of the arc tube on which the center of the bottom wall of the holding member is positioned. By doing so, the same effects as produced in the above embodiments can be produced.

Although the above embodiments describe the case where the central axis of the holding member and the spiral axis of the arc tube substantially match on the same line, these axes may not necessarily match. In the case where these axes do not match, too, the same effects as produced in the above embodiments can be produced by positioning the insertion openings, insertion-guiding units, covering units etc. of the holding member based upon the position of the spiral axis of the arc tube.

2. Shape of Arc Tube

Although the above embodiments describe the case where the present invention is applied to an art tube having a double-spiral structure, the present invention may be applied to arc tubes with other structures. As one example, the present invention may be applied to an arc tube composed of a plurality of U-shaped glass tubes that are connected with one another, e.g., a triple-tube arc tube composed of three U-shaped glass tubes or a quad-tube arc tube composed of four U-shaped glass tubes. In this case, however, such arc tubes need to have end portions at which electrodes are attached wound around a predetermined vertical axis.

The end portions of the arc tube may be wound around a predetermined vertical axis (the spiral axis in the above embodiments) in such a manner that the end portion is viewed in an arch-shape from above in the direction of the vertical axis) and is viewed in an L-shaped from side in the direction perpendicular to the vertical axis (in the case where the spiral angle is 90°). In this case, the insertion-guiding units (and the covering units) of the holding member need to be formed in the direction perpendicular to the above vertical axis. Alternatively, insertion-guiding units may be formed at the bottom wall in such a manner that the end portions of the arc tube come in contact, at only side and bottom surfaces thereof, with the insertion-guiding units. In this case, too, the ends of the arc tube can be guided to the insertion openings by rotating the arc tube around the vertical axis.

Further, only one of the end portions of the arc tube may be wound around the spiral axis. In this case, the same effects as produced in the above embodiment can be produced by the holding member having the insertion-guiding unit guiding the one end portion when the arc tube is rotated around the spiral axis. The end portion of the arc tube referred to herein is such that its length from the end of the arc tube is at least equal to the length of the insertion-guiding unit of the holding member in the spiral direction.

3. Globe

Although the above embodiments describe the case where the compact self-ballasted fluorescent lamp does not have a globe covering the arc tube, the present invention can be applied to a compact self-ballasted fluorescent lamp that has a globe.

4. Attachment Processes

The above embodiments describe the case where the holding member is fixed and the arc tube is moved, in the processes of attaching the arc tube to the holding member. To be specific, the arc tube is first moved in the spiral-axis direction and then rotated around the spiral axis, without moving the holding member. However, the attachment processes may be such that the arc tube is fixed and the holding member is moved, or both the arc tube and the holding member are moved. In either case, the same effects as produced in the above embodiments can be produced.

5. Others

Although the above embodiments describe the case where the present invention is applied to a compact self-ballasted fluorescent lamp alternative to a 60 W incandescent lamp, the present invention can be applied to other compact self-ballasted fluorescent lamps such as those alternative to a 40 W incandescent lamp and a 100 W incandescent lamp.

6. Low-pressure Mercury Lamp

Figure 16:
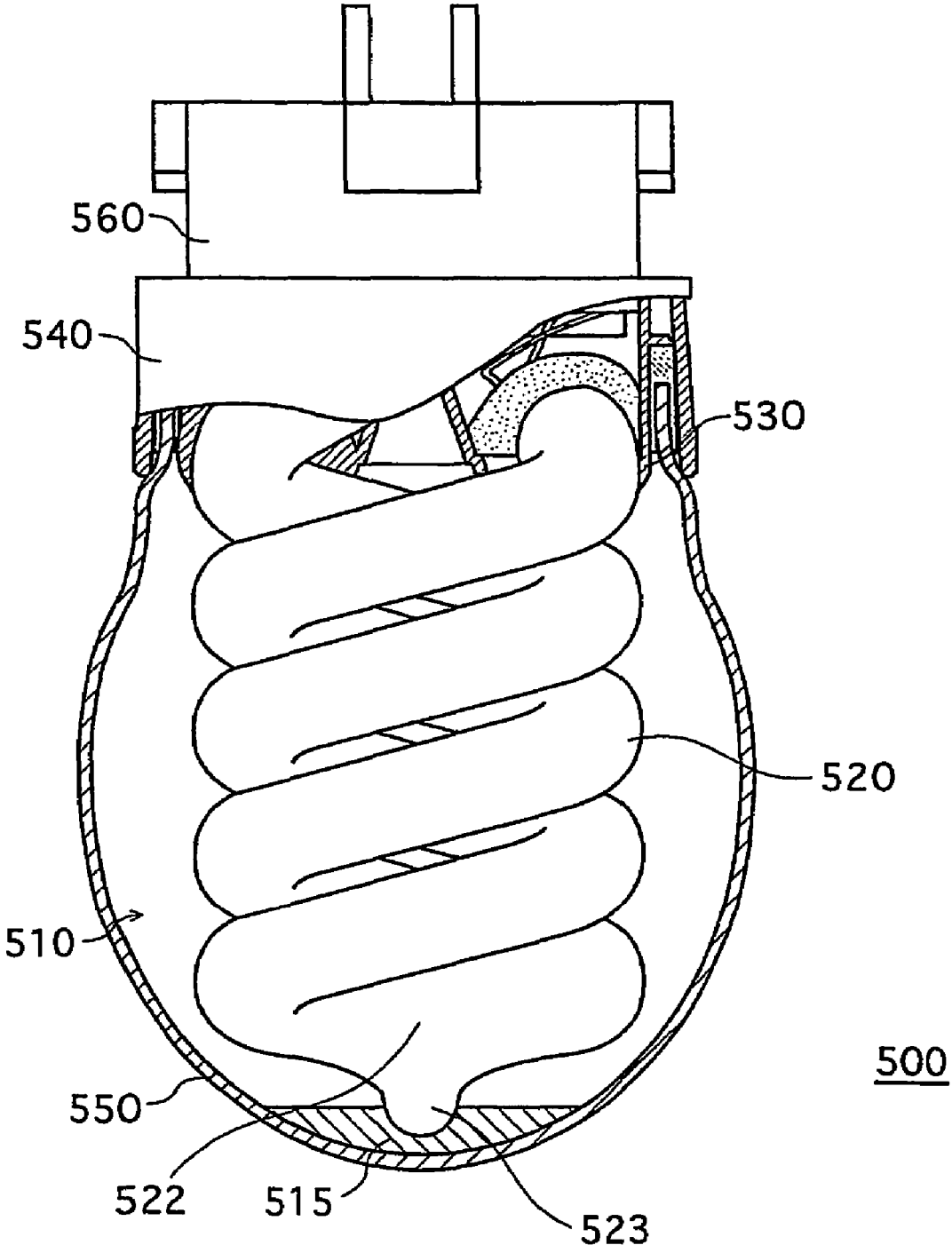
FIG. 16 is a front view of another fluorescent lamp to which the present invention is applied.

Although the above embodiments describe the case where the present invention is applied to a compact self-ballasted fluorescent lamp, the present invention can be applied to other lamps such as a compact fluorescent lamp shown in FIG. 16.

The fluorescent lamp 500 includes an arc tube 510, a holder 530, a case 540, a globe 550, and a single base 560 (e.g., a GX10q type base). The arc tube 510 has a double-spiral structure in which a glass tube 520 is wound from its middle to its ends. The holder 530 has a closed one end and is in a cylindrical shape. The holder 530 holds the arc tube 510 (specifically, end portions of the glass tube 520). The case 540 is attached at a peripheral wall of the holding member 530. The globe 550 covers the arc tube 510. The single base 560 is attached to a socket of a lighting fixture, and is supplied with power.

The fluorescent lamp 500 greatly differs from the compact self-ballasted fluorescent lamp 1 described in the above embodiments, in that an electronic ballast is not placed in an internal space formed by the holding member 530 and the case 540 and the base 560 is not of a screw type, which is the type of bases typically used for incandescent lamps.

As in the above embodiments, the holder 530 has insertion openings, guide grooves, and covering units formed at its bottom wall. With this construction, the arc tube 520 can be easily inserted into the holder 530 as in the above embodiments.

INDUSTRIAL APPLICATION

The present invention applicable to a low-pressure mercury lamp can be utilized for enabling ends of an arc tube to be easily inserted into a holding member.

The invention claimed is:

1. A low-pressure mercury lamp, comprising:

an arc tube whose at least one end is wound around an axis entirely in a longitudinal direction thereof; and a holding member that holds the arc tube in a state where the at least one end is inserted in an opening formed in a bottom wall of the holding member, wherein the holding member includes a groove that is at a position corresponding to a position of the at least one end and is continuous to the opening, and the groove is formed such that the at least one end of the arc tube wound around the axis fits therein and a depth thereof increases as a distance from the opening decreases.

2. The low-pressure mercury lamp of claim 1, wherein the insertion-guiding unit is formed as a groove extending in a direction in which the end of the arc tube is wound around the axis.

3. The low-pressure mercury lamp of claim 2, wherein a part of the groove that comes in contact with a part of the end of the arc tube has a shape corresponding to a shape of the part of the end of the arc tube.

4. The low-pressure mercury lamp of claim 1, wherein the arc tube includes a pair of lead wires for an electrode extending from the end of the arc tube, the opening opens toward a direction of the axis, and the holding member allows the pair of lead wires to be inserted in the opening.

5. The low-pressure mercury lamp of claim 4, wherein the opening is formed at an angle of 20 to 60° inclusive with respect to the axis.

6. The low-pressure mercury lamp of claim 4, wherein the holding member includes a covering unit that is formed so that the opening is positioned at an edge of the covering unit, the covering unit covering the end of the arc tube, and the opening is partially formed by a notch created in the covering unit and/or the insertion-guiding unit.

7. The low-pressure mercury lamp of claim 1, wherein the end of the arc tube is bonded within the holding member via a bonding agent.

8. The low-pressure mercury lamp of claim 7, wherein the insertion-guiding unit includes one or more inlets for injecting the bonding agent in an area between (a) the end of the arc tube placed in the holding member and (b) the insertion-guiding unit of the holding member.

9. The low-pressure mercury lamp of claim 7, wherein the holding member includes a wall at an internal surface thereof for preventing the bonding agent from flowing outside.

10. The low-pressure mercury lamp of claim 1, wherein the arc tube includes a pair of lead wires for an electrode extending from the end of the arc tube, and the holding member includes a supporting unit for supporting the pair of lead wires while keeping a certain distance between the lead wires.

11. The low-pressure mercury lamp of claim 1, wherein the arc tube includes a glass tube that is turned at a substantially middle thereof and wound around the axis from the middle, to have a double-spiral structure.

12. In a lamp having a helical arc tube wound around an axis with a first and second end portion of the arc tube supporting lead wires for electrodes that extend from the respective first and second end portions, the improvement comprising:

a holder having a bottom wall with integral first and second covering units extending above the bottom wall and a first and second groove of a configuration to receive and support a rotational movement of the first and second end portions of the arc tube, the first and second grooves are integrally recessed into the bottom wall at predetermined curved distances from the first and second covering units and progressively increase in depth as the first and second grooves curve and extend beneath the respective first and second covering units, the first and second covering units form with the first and second grooves insertion openings of a dimension to approximate a diameter of the arc tube end portions wherein the helical arc tube first and second end portions are inserted into the corresponding first and second grooves and rotated to follow the grooves and enters insertion openings in the first and second covering units for mounting the helical arc tube in the holder.

13. The lamp of claim 12 wherein the first and second grooves have respective openings through the bottom wall that extend from the insertion opening into and beneath the respective first and second covering units, wherein the lead wires can be initially inserted into the groove openings and the end portions of the arc tubes can subsequently be inserted into the grooves and rotated into the insertion openings.

14. The lamp of claim 12 wherein the holder further includes a supporting unit for supporting the lead wires positioned to receive and separate the lead wires beneath the insertion openings, the supporting unit formed integral with the holder.

* * * * *